US010935263B2

(12) United States Patent
K et al.

(10) Patent No.: US 10,935,263 B2
(45) Date of Patent: Mar. 2, 2021

(54) MULTI-CIRCUIT HVAC SYSTEM

(71) Applicant: Johnson Controls Technology Company, Auburn Hills, MI (US)

(72) Inventors: Baskaran K, Chennai (IN); Karan Garg, Pune (IN); Curtis W. Caskey, Dallastown, PA (US); Norman J. Blanton, Norman, OK (US); Anthony J. Reardon, Moore, OK (US); Zhiwei Huang, Moore, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 124 days.

(21) Appl. No.: 16/206,293

(22) Filed: Nov. 30, 2018

(65) Prior Publication Data

US 2020/0149754 A1 May 14, 2020

Related U.S. Application Data

(60) Provisional application No. 62/758,253, filed on Nov. 9, 2018.

(51) Int. Cl.

| | |
|---|---|
| ***F24F 3/153*** | (2006.01) |
| ***F25B 49/02*** | (2006.01) |
| ***F25B 39/04*** | (2006.01) |
| ***F25B 41/04*** | (2006.01) |

(52) U.S. Cl.

CPC ..... *F24F 3/153* (2013.01); *F25B 39/04* (2013.01); *F25B 41/04* (2013.01); *F25B 49/027* (2013.01)

(58) Field of Classification Search

CPC ..... F24F 3/153; F25B 39/04; F25B 41/04; F25B 49/027

USPC ..... 62/173

See application file for complete search history.

(56) References Cited

U.S. PATENT DOCUMENTS

| | | | | |
|---|---|---|---|---|
| 4,201,065 | A | 5/1980 | Griffin | |
| 6,606,872 | B1 | 8/2003 | Smith | |
| 6,860,116 | B2 | 3/2005 | Lifson et al. | |
| 7,032,411 | B2 | 4/2006 | Hebert | |
| 7,231,774 | B2 | 6/2007 | Taras et al. | |
| 10,527,323 | B2 * | 1/2020 | Ohura | F25B 13/00 |
| 2017/0176077 | A1 * | 6/2017 | Knatt | F25B 39/02 |

* cited by examiner

*Primary Examiner* — Henry T Crenshaw
(74) *Attorney, Agent, or Firm* — Fletcher Yoder, P.C.

(57) ABSTRACT

The present disclosure relates to a heating, ventilation, and/or air conditioning (HVAC) system that has a first circuit and a second circuit that each have a compressor and a condenser, a conduit extending from the second circuit downstream of the condenser to the first circuit upstream of the compressor, a valve along the conduit that may manage flow therethrough, and a controller that may operate the HVAC system in a first mode such that each circuit separately circulates the refrigerant in each circuit and transition to a second mode such that refrigerant-sharing occurs between the circuits. In response to a request to transition from the second mode to the first mode, the controller may determine an amount of refrigerant subcooling, compare the amount to a threshold value associated with the first mode, and instruct opening of the valve upon a determination that the amount is less than the threshold value.

23 Claims, 12 Drawing Sheets

MULTI-CIRCUIT HVAC SYSTEM

CROSS-REFERENCE TO RELATED APPLICATIONS

This application claims priority from and the benefit of U.S. Provisional Application Ser. No. 62/758,253, entitled "MULTI-CIRCUIT HVAC SYSTEM", filed Nov. 9, 2018, which is herein incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

The present disclosure relates generally to heating, ventilating, and/or air conditioning (HVAC) systems. A wide range of applications exist for HVAC systems. For example, residential, light commercial, commercial, and industrial systems are used to control temperatures and air quality in residences and buildings. Such systems may be dedicated to either heating or cooling, although systems are common that perform both of these functions. Very generally, these systems operate by implementing a thermal cycle in which fluids are heated and cooled to provide a desired temperature in a controlled space, such as the inside of a residence or a building.

SUMMARY

The present disclosure relates to a heating, ventilation, and/or air conditioning (HVAC) system that has a first refrigeration circuit having a first compressor and a first condenser. The first compressor may urge refrigerant in the first refrigerant circuit in a direction upstream to downstream in the first refrigerant circuit. The HVAC system has a second refrigerant circuit having a second compressor and a second condenser. The second compressor may urge refrigerant in the second refrigerant circuit in a direction upstream to downstream in the second refrigerant circuit. The HVAC system may also have a conduit extending from a portion of the second circuit that is downstream of the second condenser to a portion of the first circuit that is upstream of the first compressor, a valve disposed along the conduit and that may manage flow therethrough, and a controller that may operate the HVAC system in a first mode such that the first configuration circuit separately circulates the refrigerant in the first refrigeration circuit and the second refrigeration circuit separately circulates the refrigerant in the second refrigeration circuit. The controller may also transition the HVAC system to a second mode such that refrigerant-sharing occurs between portions of the first and second refrigeration circuits. In response to a request to transition from the second mode to the first mode, the controller may determine an amount of subcooling of refrigerant downstream of the first condenser, compare the amount of subcooling to a threshold value of subcooling associated with the first node, and instruct opening of the valve upon a determination that the amount of subcooling is less than the threshold value of subcooling associated with the first mode.

The present disclosure also relates to a control system configured to control climate characteristics in a building via a multi-circuit system that has a first refrigeration circuit having a first compressor and a first condenser. The first compressor may urge refrigerant in the first refrigeration circuit in a direction upstream to downstream in the first refrigeration circuit. The multi-circuit system may also have a second refrigeration circuit that has a second compressor and a second condenser. The second compressor may urge refrigerant in the second refrigeration circuit in a direction upstream to downstream in the second refrigeration circuit. The first and second refrigeration circuits share an evaporator. The control system may also have a controller that may receive a first command to transition operation of the multi-circuit system to a first mode of operation, in which the first and second refrigeration circuits operate separately, from a second mode of operation, in which refrigerant-sharing occurs between portions of the first and second refrigeration circuits, determine an amount of subcooling of refrigerant downstream of the first condenser, compare the amount of subcooling of refrigerant to a threshold value of subcooling associated with the first mode of operation, and send a second command to open a valve to facilitate refrigerant flow along a conduit extending from a portion of the second circuit downstream of the second condenser to a portion of the first circuit upstream of the first compressor upon a determination that the amount of subcooling is less than the threshold value of subcooling.

The present disclosure also relates to a control system configured to control climate characteristics in a building via a multi-circuit system that has a first refrigeration circuit having a first compressor and a first condenser. The first compressor may urge refrigerant in the first refrigeration circuit in a direction upstream to downstream in the first refrigeration circuit. The multi-circuit system may also have a second refrigeration circuit that has a second compressor and a second condenser. The second compressor may urge refrigerant in the second refrigeration circuit in a direction upstream to downstream in the second refrigeration circuit. The first and second refrigeration circuits share an evaporator. The control system may also have a controller that may receive a first command to transition operation of the multi-circuit system from a hybrid operation to a conventional operation, detect a lubricant level in a first sump of the first compressor, compare the lubricant level to a threshold value of lubricant associated with the conventional operation, determine that the lubricant level is less than the threshold value of lubricant, send a second command to open a lubricant valve disposed along a lubricant conduit that extends from the first sump to a second sump of the second compressor, determine an amount of subcooling of refrigerant downstream of the first condenser, compare the amount of subcooling of refrigerant to a threshold value of subcooling associated with the conventional operation, determine that the amount of subcooling is less than the threshold value of subcooling, and send a third command to open a refrigerant valve disposed along a refrigerant conduit extending from a first portion of the second circuit that is downstream of the second condenser to a second portion of the first circuit that is upstream of the first compressor.

BRIEF DESCRIPTION OF THE DRAWINGS

Various aspects of this disclosure may be better understood upon reading the following detailed description and upon reference to the drawings in which.

DETAILED DESCRIPTION

Figure 1:
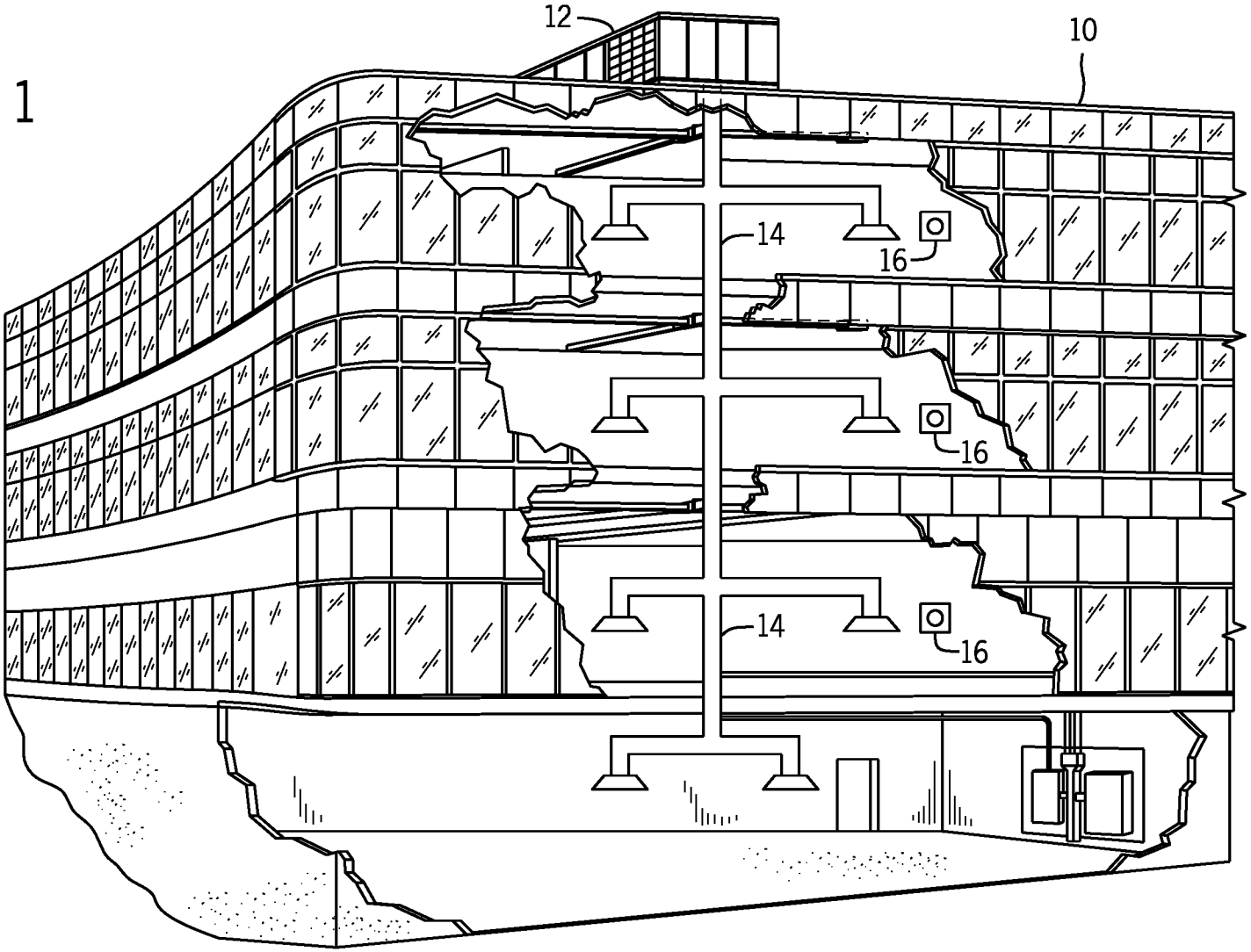
FIG. 1 is a schematic of an embodiment of an environmental control system for building environmental management that may employ an HVAC unit, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A heating, ventilating, and/or air conditioning (HVAC) unit may be an air-cooled system that implements a refrigerant cycle to provide conditioned air to a building. Specifically, the HVAC unit may include a vapor compression system configured to circulate a refrigerant through a circuit that includes a compressor, a condenser, an expansion device, and an evaporator. Certain vapor compression systems may include multiple circuits in which the refrigerant may be circulated. For example, a multi-circuit vapor compression and/or HVAC system having two circuits may circulate a refrigerant through a first circuit, a second circuit, or both, based on a call to provide conditioned air to a building. The vapor compression system may determine that the multi-circuit system may operate under full load conditions or part load conditions based on the call received. Under full load conditions, the multi-circuit vapor compression system may circulate the refrigerant through a first active circuit and a second active circuit. As used herein, an "active circuit" may refer to a refrigerant circuit with a compressor that has been activated to circulate refrigerant through the circuit. In contrast, under part load conditions, the multi-circuit vapor compression system may circulate the refrigerant through a first, active circuit, while the compressor of a second, inactive circuit is deactivated. As used herein, an "inactive circuit" may refer to a refrigerant circuit with a compressor that has not been activated to circulate refrigerant through the circuit or with a compressor that has been deactivated. In other words, under part load conditions, the multi-circuit vapor compression system does not circulate refrigerant through the inactive circuit. As such, the heat transfer area of the inactive circuit is not utilized to transfer thermal energy between the refrigerant and a fluid, such as ambient or environmental air.

Accordingly, embodiments of the present disclosure are directed to an HVAC system having a multi-circuit system that may utilize the heat transfer area of a first, active circuit in addition to the heat transfer area of a portion of a second, inactive circuit under part load conditions. That is, under part load conditions, the multi-circuit system may operate in a hybrid mode in which the refrigerant is circulated through an active circuit and at least a portion of the inactive circuit such that refrigerant-sharing occurs between portions of the active and inactive refrigeration circuits, as compared to a conventional operating mode in which a refrigerant is circulated through an active circuit but not any portion of an inactive circuit. As such, the hybrid mode operation of the multi-circuit system may increase a heat transfer efficiency and a net cooling capacity of the multi-circuit system and the HVAC system overall as compared to the conventional mode of operation of the multi-circuit HVAC system. The hybrid mode of operation of the multi-circuit HVAC system may also decrease the power consumption of the active circuit compressor by providing additional heat transfer area to the active circuit as compared to the power consumption of the active circuit compressor during the conventional mode of operation of the multi-circuit system.

Additionally, present embodiments of the HVAC system may facilitate a transition in the operation of the multi-circuit HVAC system from the hybrid mode to the conventional mode under full load conditions. During the hybrid mode of operation of the multi-circuit system, at least a portion of a lubricant, at least a portion of a refrigerant, or both, from the inactive circuit may migrate to the active circuit. In such circumstances, an amount of refrigerant, an amount of lubricant, or both, in the inactive circuit may be insufficient or inadequate as the inactive circuit transitions to active operation, such as upon activation of the compressor of the inactive circuit. As such, present embodiments of the HVAC system may be configured to balance the amount of lubricant, the amount of refrigerant, or both, between the active circuit and the inactive circuit in the multi-circuit system, such that each circuit has at least a sufficient amount of refrigerant and at least a sufficient amount of lubricant to operate under full load conditions, before the multi-circuit system transitions from the hybrid mode to the conventional mode under full load conditions.

Further, the HVAC system may facilitate a transition in the operation of the multi-circuit system from hybrid mode to conventional mode under part load conditions, such as in response to one or more operational conditions associated with the multi-circuit system. In one embodiment, the HVAC system may facilitate a transition in the operation of the multi-circuit system from a hybrid mode to a conventional mode in response to a determination that the head pressure of an active circuit compressor is less than a threshold pressure. For example, the HVAC system may transition operation of the multi-circuit system from the hybrid mode to the conventional mode in response to a determination that the head pressure of an active circuit compressor is less than 250 PSIG. In another embodiment, the HVAC system may facilitate a transition in operation of the multi-circuit system from a hybrid mode to a conventional mode in response to a determination that a circuit of the multi-circuit system has a reduced amount of refrigerant or is losing refrigerant. As such, the HVAC system may transition the operation of the multi-circuit system from the hybrid mode to the conventional mode under part load conditions to maintain the operation of at least one circuit of the multi-circuit system in response to one or more operational conditions associated with the multi-circuit system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
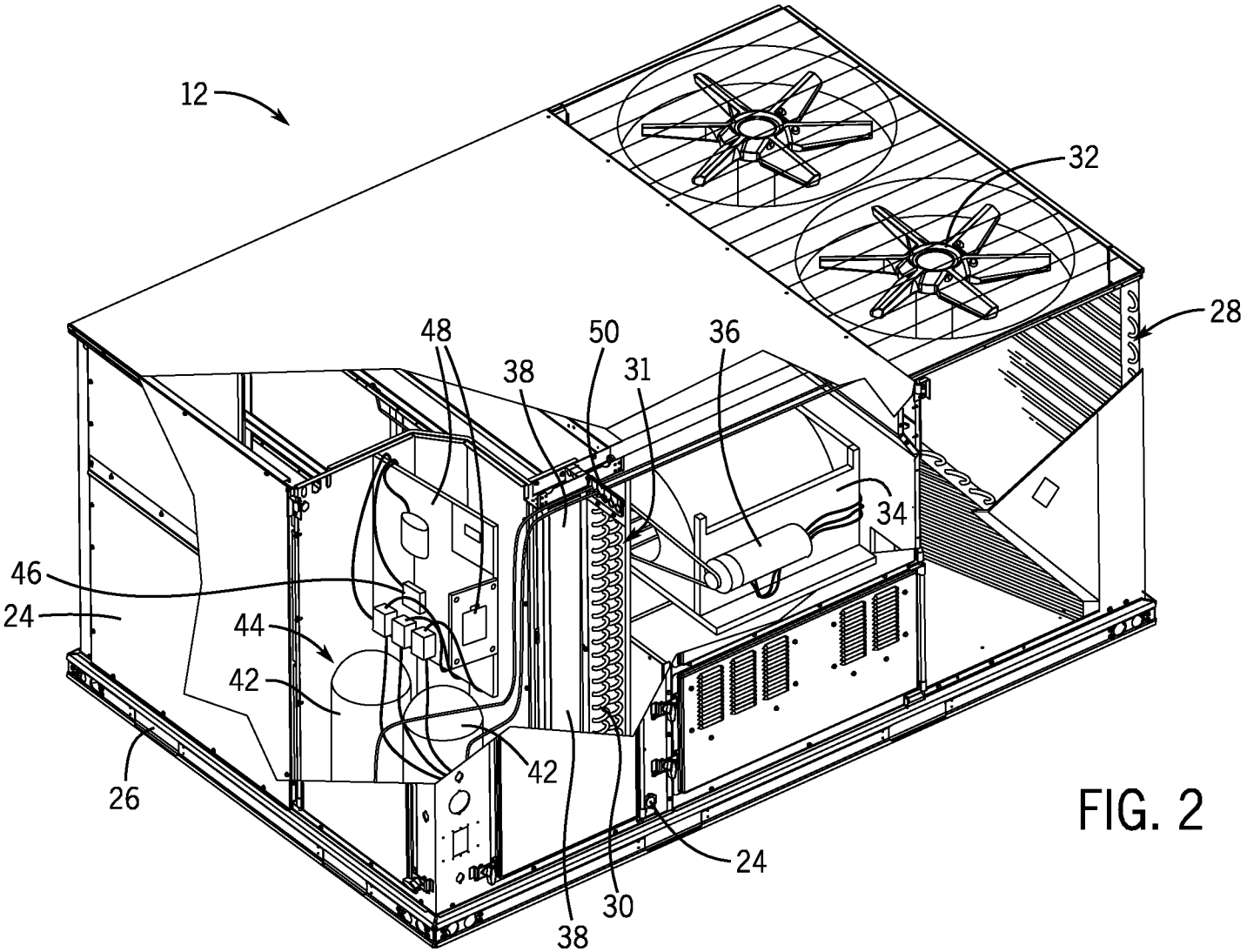
FIG. 2 is a perspective view of an embodiment of a packaged HVAC unit that may be used in the environmental control system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
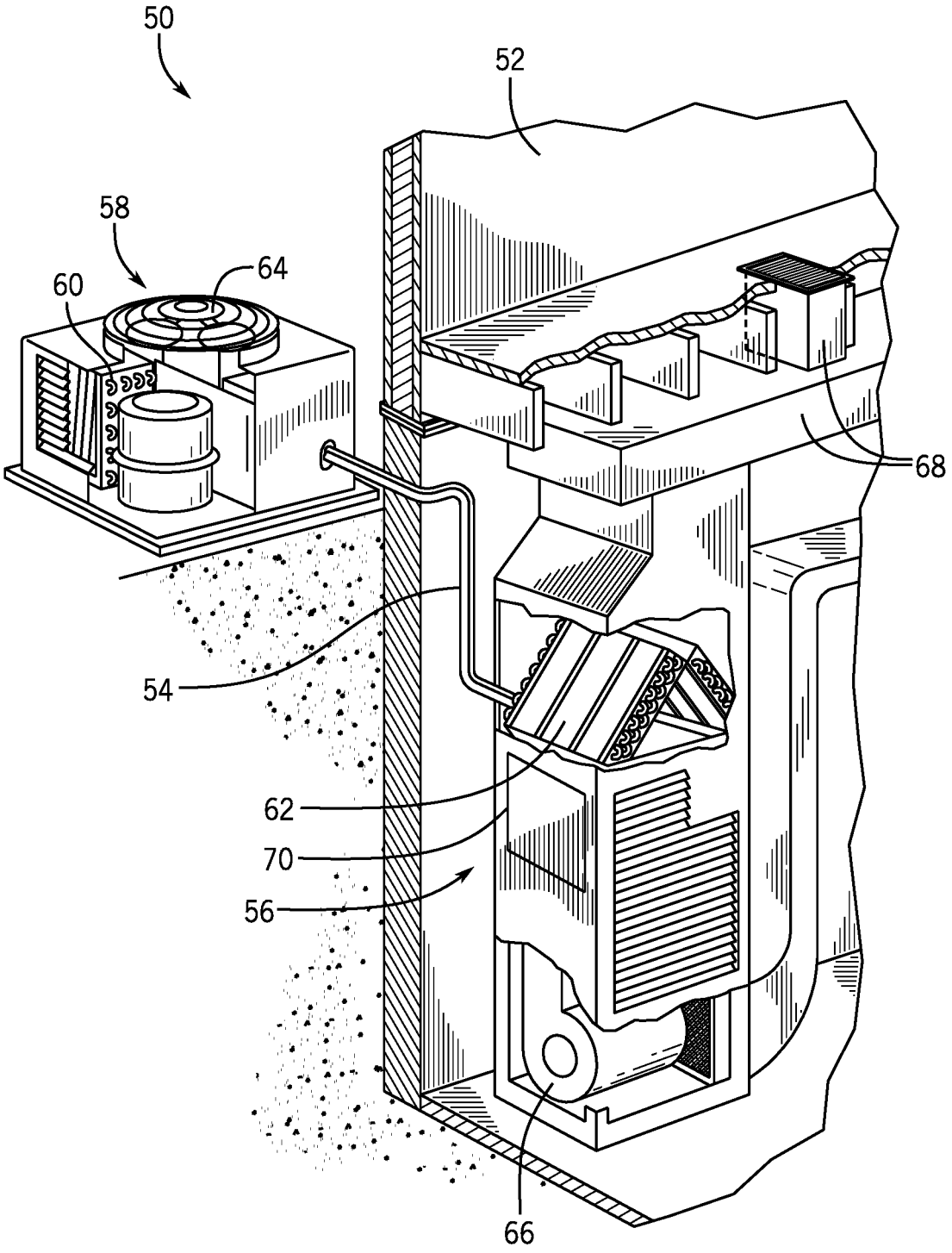
FIG. 3 is a schematic of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
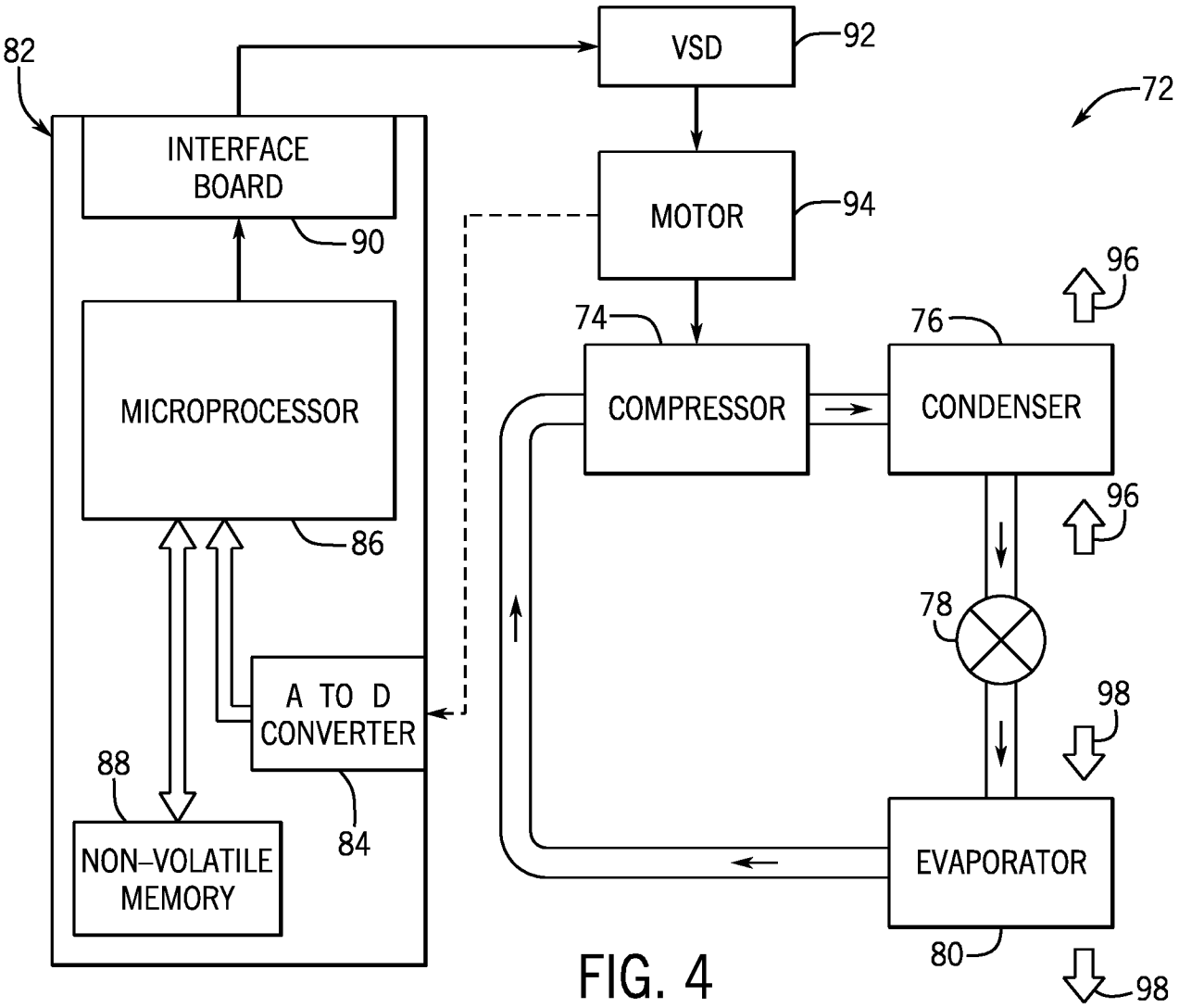
FIG. 4 is a schematic of an embodiment of a vapor compression system that may be used in any of the systems of FIGS. 1-3, in accordance with an aspect of the present disclosure.

FIG. 4 is an embodiment of a vapor compression system 72 that may be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, embodiments of the present disclosure are directed to an HVAC system having a multi-circuit system that may selectively and/or alternatingly operate in a hybrid mode e.g., a second mode) and in a conventional mode (e.g., a first mode). As used herein, "hybrid mode" refers to a part load operation of the multi-circuit system in which a refrigerant is circulated through an active circuit of the multi-circuit system and a portion of an inactive circuit of the multi-circuit system such that refrigerant-sharing occurs between portions of the active and inactive refrigeration circuits. In this manner, during hybrid mode operation, the multi-circuit system utilizes the heat transfer area of the portion of the inactive circuit in addition to the heat transfer area of the active circuit to transfer heat between the refrigerant and a fluid, such as ambient or environmental air, flowing through the multi-circuit system. Also, as used herein, "conventional mode" refers to an operation of the multi-circuit system in which a refrigerant is circulated through a refrigerant circuit having an activated compressor, thereby utilizing the heat transfer area of the active circuit to transfer heat between the refrigerant and a fluid, such as ambient or environmental air, flowing through the multi-circuit system. Under part load conditions, a conventional mode of operation of the multi-circuit system may circulate a refrigerant through a single active circuit that has an activated compressor. Under full load conditions, a conventional mode of operation of the multi-circuit system may circulate a refrigerant through two active circuits, each circuit having its own activated compressor.

As discussed below, during part load conditions, the presently-disclosed hybrid mode of operation of the multi-circuit system may increase a heat transfer efficiency and a net cooling capacity of the HVAC system as compared to conventional modes of operation used in part load conditions. In particular, during part load conditions, the hybrid mode of operation of present embodiments utilizes the heat transfer area of a portion of an inactive circuit with an active circuit by sharing refrigerant between portions of the active and inactive refrigeration circuits. The hybrid mode of operation of the multi-circuit system may also decrease the power consumption of the active compressor of the active circuit during part load conditions by providing the additional heat transfer area to the active circuit, as compared to the power consumption of an active circuit compressor during a conventional mode of operation under part load conditions.

In addition, the disclosed HVAC systems may facilitate a transition in the operation of the multi-circuit system from a hybrid mode to a conventional mode, such as when the HVAC system transitions from part load conditions to full load conditions. More specifically, by balancing the amount of lubricant, the amount of refrigerant, or both, between the active circuit and the inactive circuit in the multi-circuit system, the HVAC system may ensure that the active circuit and the inactive circuit of the multi-circuit system each have a sufficient or adequate amount of refrigerant and a sufficient or adequate amount of lubricant to operate in conventional mode under full load conditions after operating in part load conditions. Further, the HVAC system may facilitate a transition in the operation of the multi-circuit system from the hybrid mode to the conventional mode in response to one or more operational conditions associated with the multi-circuit system. For example, the HVAC system may facilitate a transition in the operation of the multi-circuit system from the hybrid mode to the conventional mode in response to a determination that the head pressure of the active compressor of an active circuit is less than a threshold pressure or a determination that a circuit of the multi-circuit system is losing refrigerant.

Figure 5:
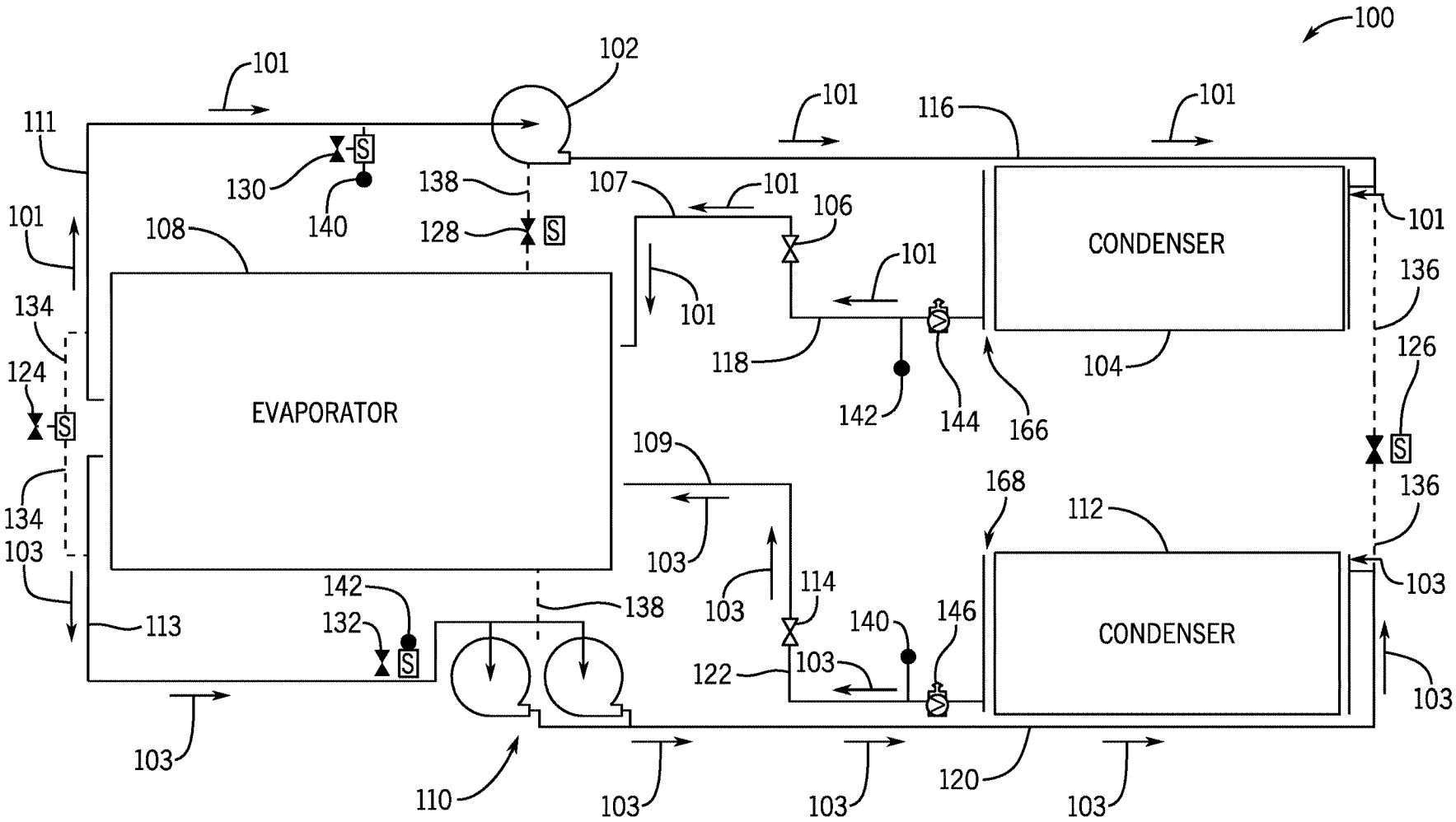
FIG. 5 is a schematic of an embodiment of a multi-circuit HVAC system that may be used in any of the systems of FIGS. 1-4, in accordance with an aspect of the present disclosure.

With the foregoing in mind, FIG. 5 illustrates an embodiment of a multi-circuit system 100 that may be used in the HVAC unit 12 shown in FIGS. 1 and 2, the residential heating and cooling system 50 shown in FIG. 3, or the vapor compression system 72 shown in FIG. 4. The multi-circuit system 100 may include a first circuit, as indicated by arrows 101, having a first compressor 102, a first condenser 104, and a first expansion device 106 and a second circuit, as indicated by arrows 103, having a second compressor 110, a second condenser 112, and a second expansion device 114. Although the first compressor 102 is illustrated as a single compressor and the second compressor 110 is illustrated as a tandem compressor, the first compressor 102, the second compressor 110, or both, may include any suitable compressor configuration. Additionally, the first circuit and the second circuit of the multi-circuit system 100 may each include an evaporator 108. In other words, the evaporator 108 is common to the first circuit and the second circuit. However, the first and second circuits may flow individually through the evaporator 108. The first circuit and the second circuit of the multi-circuit system 100 may each have a respective supply conduit 107, 109 to the evaporator 108 and a separate, respective discharge conduit 111, 113 from the evaporator 108, such that the refrigerant flowing within the first circuit and the refrigerant flowing within the second circuit do not mix as the refrigerant from each circuit passes through the evaporator 108. In certain embodiments, the first and second circuits may be arranged within the evaporator 108 in a split row configuration, in a split face configuration, in an interlaced configuration, or in any other suitable configuration.

As illustrated in FIG. 5, during a conventional mode of operation of the multi-circuit system 100 under part load conditions, a refrigerant is circulated through the first circuit, as indicated by arrows 101. Within the first circuit, the first compressor 102 may compress a refrigerant vapor and deliver the refrigerant vapor to the first condenser 104 through a discharge conduit 116. The refrigerant vapor delivered by the first compressor 102 to the first condenser 104 may transfer heat to a fluid passing across the first condenser 104, such as ambient or environmental air. The refrigerant vapor may condense to a refrigerant liquid in the first condenser 104 as a result of thermal heat transfer with the fluid passing across the first condenser 104. The liquid refrigerant from the first condenser 104 may flow through a discharge conduit 118 to the first expansion device 106 and from the first expansion device 106 through the supply conduit 107 to the evaporator 108. The liquid refrigerant delivered to the evaporator 108 may absorb heat from a fluid passing across the evaporator 108, such as a supply air flow to be provided to a conditioned space, such as a space within the building 10. The liquid refrigerant in the evaporator 108 may undergo a phase change from the liquid refrigerant to a refrigerant vapor. In this manner, the evaporator 108 may reduce the temperature of the fluid passing across the evaporator 108 via thermal heat transfer with the refrigerant. Thereafter, the vapor refrigerant exits the evaporator 108 through the discharge conduit 111 and returns to the first compressor 102 to complete the cycle of the first circuit.

Alternatively, during the conventional mode of operation of the multi-circuit system 100 under part load conditions, a refrigerant may be circulated through the second circuit, as indicated by arrows 103. Within the second circuit, the second compressor 110 may compress a refrigerant vapor and deliver the refrigerant vapor to the second condenser 112 through a discharge conduit 120. The refrigerant vapor delivered by the second compressor 110 to the second condenser 112 may transfer heat to a fluid passing across the second condenser 112, such as ambient or environmental air. The refrigerant vapor may condense to a refrigerant liquid in the second condenser 112 as a result of thermal heat transfer with the fluid passing across the second condenser 112. The liquid refrigerant from the second condenser 112 may flow through a discharge conduit 122 to the second expansion device 114 and from the second expansion device 114 through the supply conduit 109 to the evaporator 108. The liquid refrigerant delivered to the evaporator 108 may absorb heat from a fluid passing across the evaporator 108, such as a supply air flow to be provided to a conditioned space, such as a space within the building 10. The liquid refrigerant in the evaporator 108 may undergo a phase change from the liquid refrigerant to a refrigerant vapor. In this manner, the evaporator 108 may reduce the temperature of the fluid passing across the evaporator 108 via thermal heat transfer with the refrigerant. Thereafter, the vapor refrigerant exits the evaporator 108 through the discharge conduit 113 to complete the cycle of the second circuit.

Under full load conditions, the multi-circuit system 100 may operate in the conventional mode and may circulate a first refrigerant through the first circuit and a second refrigerant through the second circuit, in the manners described above. In some embodiments, the first circuit and the second circuit of the multi-circuit system 100 may each be incorporated in the vapor compression system 72 of FIG. 4. For example, the components of the first circuit and the components of the second circuit may be coupled to a respective control panel 82 (e.g., a controller) that has the A/D converter 84, the microprocessor 86, the non-volatile memory 88, and/or the interface board 90. The control panel 82 and its components may function to regulate operation of the components of first circuit and the components of the second circuit, respectively, based on feedback from an operator, from sensors of the vapor compression system 72 that detect operating conditions, and so forth. In certain embodiments, the control panel 82 (e.g., a controller) of the first circuit and the control panel 82 (e.g., a controller) of the second circuit may be the same control panel and may function to regulate operation of the first circuit, the second circuit, or both, of the multi-circuit system 100.

Further, the multi-circuit system 100 may also include a plurality of valves, including valves 124, 126, 128, 130, and 132 disposed along a plurality of respective bridging conduits 134, 136, 138, 140, and 142 that fluidly couple the first circuit of the multi-circuit system 100 and the second circuit of the multi-circuit system 100. Each valve 124, 126, 128, 130, and 132 of the plurality of valves may be a solenoid valve or any other suitable type of electromechanical device for controlling a fluid flow through the conduit along which the valve is disposed. Each bridging conduit 134, 136, 138, 140, and 142 may include copper tubing or any other suitable material. Further, the multi-circuit system 100 may include a first temperature sensor 144 positioned at or near a first refrigerant exit 166 of the first condenser 104 and the second temperature sensor 146 positioned at or near a second refrigerant exit 168 of the second condenser 112. In certain embodiments, the first temperature sensor 144 may be disposed at a position along the discharge conduit 118 of the first circuit downstream of the first condenser 104 and upstream of the first expansion device 106, and the second temperature sensor 146 may be disposed at position along the discharge conduit 122 of the second circuit downstream of the second condenser 112 and upstream of the second expansion device 114. The first temperature sensor 144 may measure an amount of subcooling of a refrigerant discharged from the first condenser through the first refrigerant exit 166, and the second temperature sensor 146 may measure an amount of subcooling of a refrigerant discharged from the second condenser through the second refrigerant exit 168. In certain embodiments, the first temperature sensor 144 and the second temperature sensor 146 may be thermocouples or any other suitable type of temperature sensor for measuring temperature, including an amount of subcooling, of a refrigerant.

As discussed above, the multi-circuit system 100 may transition between operating in a conventional mode and operating in a hybrid mode. During a conventional mode of operation of the multi-circuit system 100, each valve 124, 126, 128, 130, and 132 of the plurality of valves in the multi-circuit system 100 remains closed to block refrigerant flow between the first circuit and the second circuit. As such, under part load conditions, a first refrigerant may circulate through the first circuit, or a second refrigerant may circulate through the second circuit. When the multi-circuit system 100 operates in the conventional mode under full load conditions, the first refrigerant may circulate through the first circuit and the second refrigerant may circulate through the second circuit simultaneously.

Figure 6:
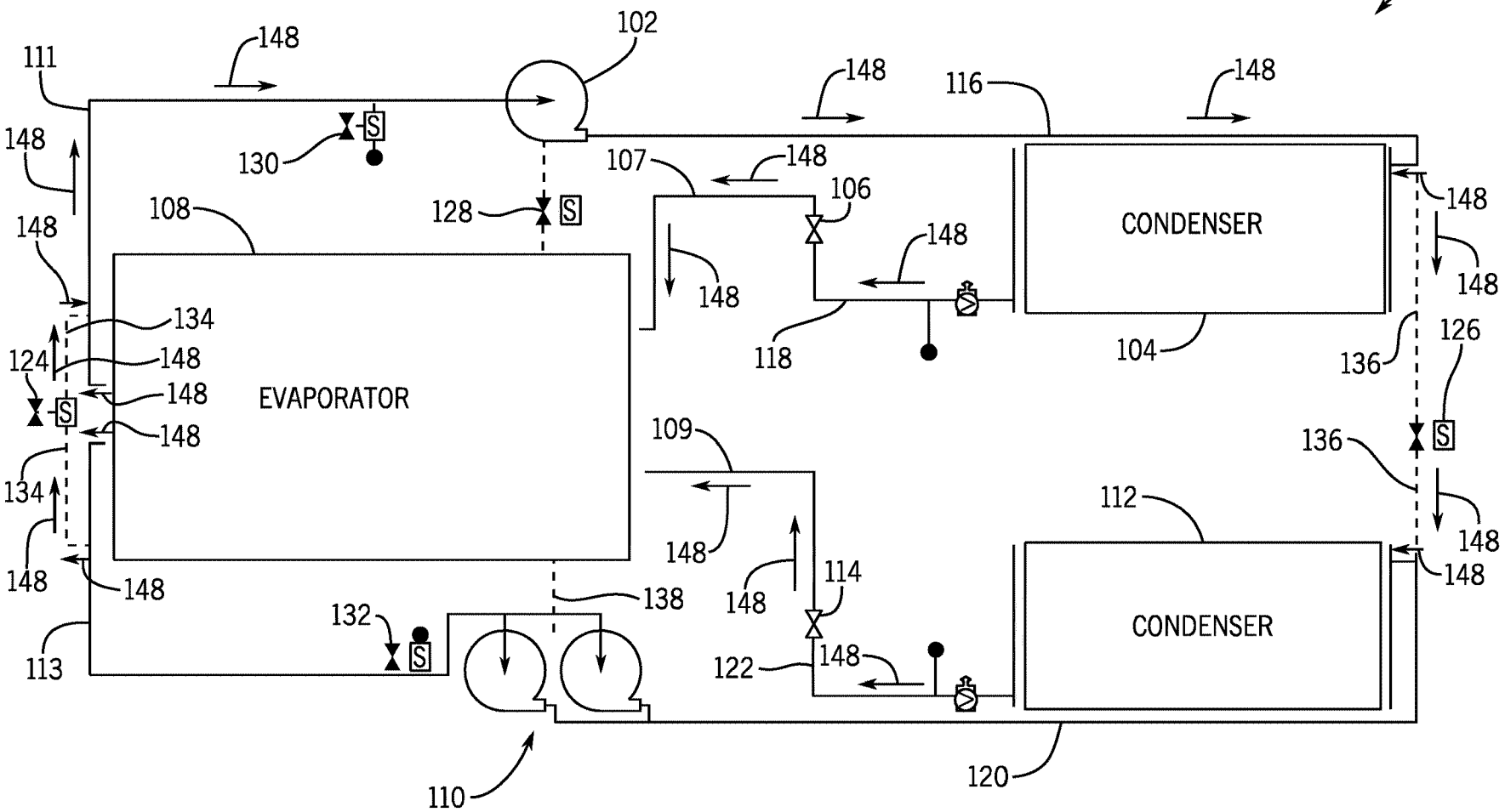
FIG. 6 is a schematic of an embodiment of a multi-circuit HVAC system operating in a hybrid mode, in accordance with an aspect of the present disclosure.

During the hybrid mode of operation of the multi-circuit system 100, valves 124 and 126 are open, while the other valves 128, 130, and 132 remain closed. With the foregoing in mind, FIG. 6 is a schematic of an embodiment of the multi-circuit system 100 of FIG. 5 during the hybrid mode of operation. During the hybrid mode of operation, the multi-circuit system 100 may circulate a refrigerant through a hybrid circuit, as indicated by arrows 148, such that refrigerant-sharing occurs between portions of the first and the second refrigeration circuits. Starting with the first compressor 102, the first compressor 102 may compress a refrigerant vapor and deliver a first portion of the refrigerant vapor to the first condenser 104 through the discharge conduit 116 and may deliver a second portion of the refrigerant vapor to the second condenser 112 through the bridging conduit 136. The second portion of the refrigerant vapor may pass through the valve 126, which is open, and may enter the second condenser 112. In some embodiments, a check valve may be disposed along the discharge conduit 120 downstream of the second compressor 110 and upstream of the second condenser 112 to block the second portion of the refrigerant vapor from flowing to the second compressor 110. In other embodiments, the first compressor 102 and/or the second compressor 110 may be scroll compressors, which have an integral check valve.

The first portion of the refrigerant vapor delivered by the first compressor 102 to the first condenser 104 may transfer heat to the fluid passing across the first condenser 104, and the second portion of the refrigerant vapor delivered by the first compressor 102 to the second condenser 112 may transfer heat to the fluid passing across the second condenser 112. The first portion of the refrigerant vapor may condense to a refrigerant liquid in the first condenser 104 as a result of thermal heat transfer with the fluid passing across the first condenser 104, and the second portion of the refrigerant vapor may condense to a refrigerant liquid in the second condenser 112 as a result of thermal heat transfer with the fluid passing across the second condenser 104. The liquid refrigerant from the first condenser 104 may flow through the discharge conduit 118 to the first expansion device 106 and from the first expansion device 106 through the supply conduit 107 to the evaporator 108. Additionally, the liquid refrigerant from the second condenser 112 may flow through the discharge conduit 122 to the second expansion device 114 and from the second expansion device 114 through the supply conduit 109 to the evaporator 108. The liquid refrigerant delivered to the evaporator 108 from the supply conduits 107, 109 may absorb heat from the fluid passing across the evaporator 108. As such, the liquid refrigerant in the evaporator 108 may undergo a phase change from the liquid refrigerant to a refrigerant vapor. For example, the liquid refrigerant delivered to the evaporator 108 from the supply conduit 107 may undergo a phase change to a first refrigerant vapor, and the liquid refrigerant delivered to the evaporator 108 from the supply conduit 109 may undergo a phase change to a second refrigerant vapor. Thereafter, the first vapor refrigerant may be discharged from the evaporator 108 through the discharge conduit 111, and the second vapor refrigerant may be discharged from the evaporator 108 through the discharge conduit 113.

The second vapor refrigerant may then flow through valve 124, which is open, via the bridging conduit 134 and may mix with the first vapor refrigerant in discharge conduit 111. In some embodiments, a check valve may be disposed along the discharge conduit 113 upstream of the second compressor 110 to block the second vapor refrigerant from flowing to the second compressor 110. The mixture of the first vapor refrigerant and the second vapor refrigerant may then return to the first compressor 102 to complete the cycle of the hybrid circuit. As such, during the hybrid mode of operation of the multi-circuit system 100, the first compressor 102 may mobilize the refrigerant through the first circuit and a portion of the second circuit, thereby utilizing the heat transfer area of the first or "active" circuit and a portion of heat transfer area of the second or "inactive" circuit to transfer heat between the refrigerant and a fluid passing through the multi-circuit system 100.

Although the hybrid mode of operation of the multi-circuit system 100 is described above with reference to the first compressor 102 as the active compressor of the multi-circuit system 100, it should be understood that in certain embodiments, the second compressor 110 may mobilize the refrigerant during the hybrid mode of operation of the multi-circuit system 100 instead of the first compressor 102. As such, during the hybrid mode of operation of the multi-circuit system 100, the second circuit may be the active circuit, and the first circuit may be the inactive circuit. For example, a refrigerant may circulate through a hybrid circuit of the multi-circuit system 100 starting with the second compressor 110. The second compressor 110 may compress a refrigerant vapor and deliver a first portion of the refrigerant vapor to the second condenser 112 and a second portion of the refrigerant vapor to the first condenser 104 through the valve 126, which is open, via the bridging conduit 136. In some embodiments, a check valve may be disposed along the discharge conduit 116 downstream of the first compressor 102 and upstream of the first condenser 101 to block the second portion of the refrigerant vapor from flowing to the first compressor 102.

The first portion of the refrigerant vapor may condense to a refrigerant liquid in the second condenser 112 as a result of thermal heat transfer with a fluid passing across the second condenser 112, and the first portion of the refrigerant vapor may condense to a refrigerant liquid in the first condenser 104 as result of thermal heat transfer with a fluid passing across the first condenser 104. The liquid refrigerant from the second condenser 112 may flow through the second expansion device 114 to the evaporator 108, and the liquid refrigerant from the first condenser 104 may flow through the first expansion device 106 to the evaporator 108. The liquid refrigerant delivered to the evaporator 108 may absorb heat from a fluid passing through the evaporator 108 and undergo a phase change from the liquid refrigerant to a refrigerant vapor. The refrigerant from the second condenser 112 and the refrigerant from the first condenser 112 may flow through separate conduits within the evaporator 108. As such, a first vapor refrigerant may exit the evaporator 108 through the discharge conduit 113, and a second vapor refrigerant may exit the evaporator 108 through the discharge conduit 111. The second vapor refrigerant may then flow through valve 124, which is open, via the bridging conduit 134 and mix with the first vapor refrigerant in discharge conduit 113. In some embodiments, a check valve may be disposed along the discharge conduit 111 upstream of the first compressor 102 to block the second vapor refrigerant from flowing to the first compressor 102. The mixture of the first vapor refrigerant and the second vapor refrigerant may then return to the second compressor 110 to complete the cycle of the hybrid circuit. As such, during a hybrid mode of operation of the multi-circuit system 100, the second compressor 110 may mobilize the refrigerant through the second or "active" circuit and a portion of the first or "inactive" circuit, thereby utilizing the heat transfer area of the first, active circuit and a portion of the heat transfer area of the second, inactive circuit to transfer heat between the refrigerant and a fluid passing through the multi-circuit system 100.

Figure 7:
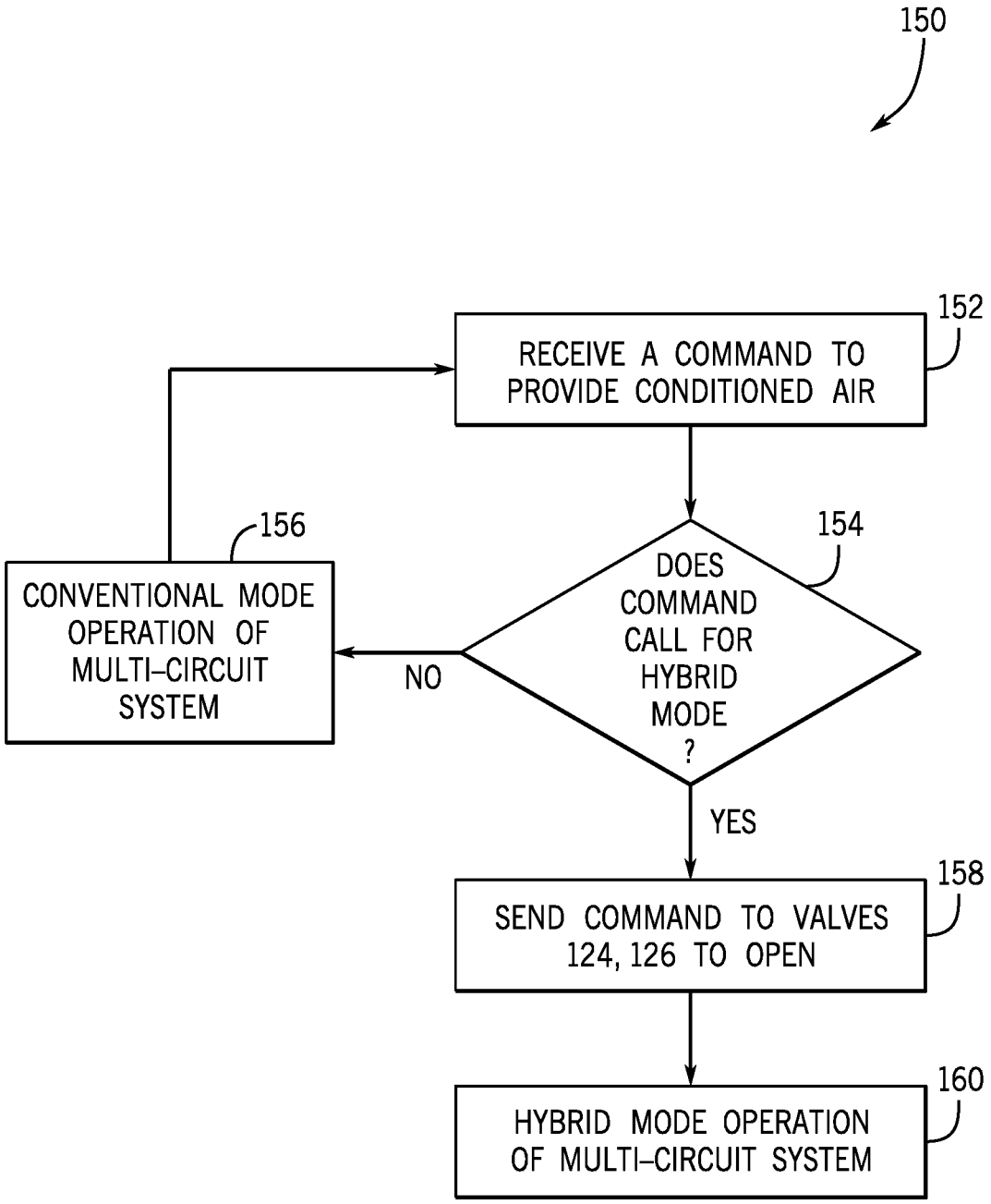
FIG. 7 is a flowchart for a method of determining an operating mode of a multi-circuit HVAC system, in accordance with an aspect of the present disclosure.

With the foregoing in mind, FIG. 7 illustrates a flow chart of a method 150 for determining an operation of the multi-circuit system 100 based on a command received by an HVAC system configured to provide conditioned air to a space, such as a building or a room. Although the following description of the method 150 is described in a particular order, it should be noted that the method 150 is not limited to the depicted order, and instead, the method 150 may be performed in any suitable order. Moreover, although the method 150 is described as being performed by a control system (e.g., a controller) of an HVAC system, it should be noted that the method 150 may be performed by the control device 16 (e.g., a controller) shown in FIG. 1, the control board 48 (e.g., a controller) shown in FIG. 2, the control panel 82 (e.g., a controller) shown in FIG. 4, or any other suitable device. For example, the control system of the HVAC system may include microprocessor 86 and memory 88 of the control panel 82. The microprocessor 86 may be used to execute software, such as software for providing commands and/or data to the control system, and so forth. Additionally, the microprocessor 86 may include multiple microprocessors, one or more "general-purpose" microprocessors, one or more special-purpose microprocessors, and/or one or more application specific integrated circuits (ASICS), or some combination thereof. The memory 88 may include a volatile memory, such as RAM, and/or a nonvolatile memory, such as ROM. The memory 88 may store a variety of information and may be used for various purposes. For example, the memory 88 may store processor-executable instructions for the microprocessor 86 to execute, such as instructions for providing commands and/or data to the control system.

Referring now to FIG. 7, at block 152, the control system of the HVAC system may receive a command to provide conditioned air to a space, such as a room or a building. For example, a user may input a command to adjust the temperature of a room or a building to a desired temperature into a system controller or a thermostat of the HVAC system. At block 154, the control system of the HVAC system may determine whether the multi-circuit system 100 should operate in a hybrid mode under part load conditions or a conventional mode under full load conditions based on the command received at block 152. In one embodiment, the control system may determine that the multi-circuit system 100 may operate in the hybrid mode or the conventional mode based on a corresponding amount of conditioned air or a corresponding temperature of the conditioned air that is to be provided to the space. After determining that the multi-circuit system 100 should operate in the hybrid mode based on the received input, the control system of the HVAC system may send a command signal to valves 124 and 126 of the multi-circuit system 100 to open, as indicated at block 158. Thereafter, the control system of the HVAC system may send a command signal to the first compressor 102 or the second compressor 110 to activate and mobilize a refrigerant through a hybrid circuit of the multi-circuit system, as described above. As such, at block 160, the multi-circuit system 100 may operate in the hybrid mode and may circulate the refrigerant through the hybrid circuit under part load conditions.

Referring back to block 154, the control system of the HVAC system may determine that the multi-circuit system 100 should operate in conventional mode, such as under full load conditions. The control system may send a command signal to the first compressor 102 and the second compressor 110 to activate and mobilize a refrigerant through the first circuit and the second circuit, as described above. As such, at block 156, the multi-circuit system 100 may operate in conventional mode under full load conditions.

In certain embodiments, at block 152, the control system of the HVAC system may receive another command to provide conditioned air to the space while the multi-circuit system 100 is operating in the conventional mode under full load conditions. For example, a user may input a command to a system controller or a thermostat to adjust the temperature of a room or a building to a different temperature than a previously-entered temperature. In such embodiments, the control system of the HVAC system may repeat the steps of the method 150 at blocks 154 to 160.

In other embodiments, the control system of the HVAC system may receive another command to provide conditioned air to the space while the multi-circuit system 100 is operating in the hybrid mode. For example, a user may input a command to a system controller or a thermostat to adjust the temperature of a room or a building to a different temperature than a previously-entered temperature. The control system of the HVAC system may then determine that the multi-circuit system 100 should operate in the conventional mode under full load conditions based on the command to provide conditioned air. As discussed above, in the hybrid mode of operation, the multi-circuit system 100 circulates refrigerant through an active circuit and a portion of an inactive circuit such that refrigerant-sharing occurs between portions of the active and inactive refrigeration circuits. During the hybrid mode of operation, at least a portion of a lubricant, such as oil, may migrate from the sump of the inactive compressor to the sump of the active compressor in the multi-circuit system 100 because the lubricant in the sump of the inactive compressor is at a negative pressure. Additionally, during the hybrid mode of operation of the multi-circuit system 100, the active compressor may draw at least a portion of the refrigerant from the inactive circuit to the active circuit, such as via the bridging conduit 134 and/or 136.

Thus, the inactive circuit may not have a sufficient amount of lubricant, a sufficient amount of refrigerant, or both, in the inactive circuit to operate at standard conditions after the multi-circuit system 100 transitions from the hybrid mode of operation to the conventional mode of operation under full load conditions. Accordingly, the HVAC system may be configured to balance the amount of lubricant between the sump of the active compressor and the sump of the inactive compressor, such that the sump of the active compressor and the sump of the inactive compressor have at least a sufficient or adequate amount of lubricant for the multi-circuit system 100 to operate in the conventional mode under full load conditions. Additionally, or alternatively, the HVAC system may be configured to balance the amount of refrigerant between the active circuit and the inactive circuit of the multi-circuit system 100, such that the active circuit and the inactive circuit have at least a sufficient or adequate amount of refrigerant for the multi-circuit system 100 to operate in the conventional mode under full load conditions.

Figure 8:
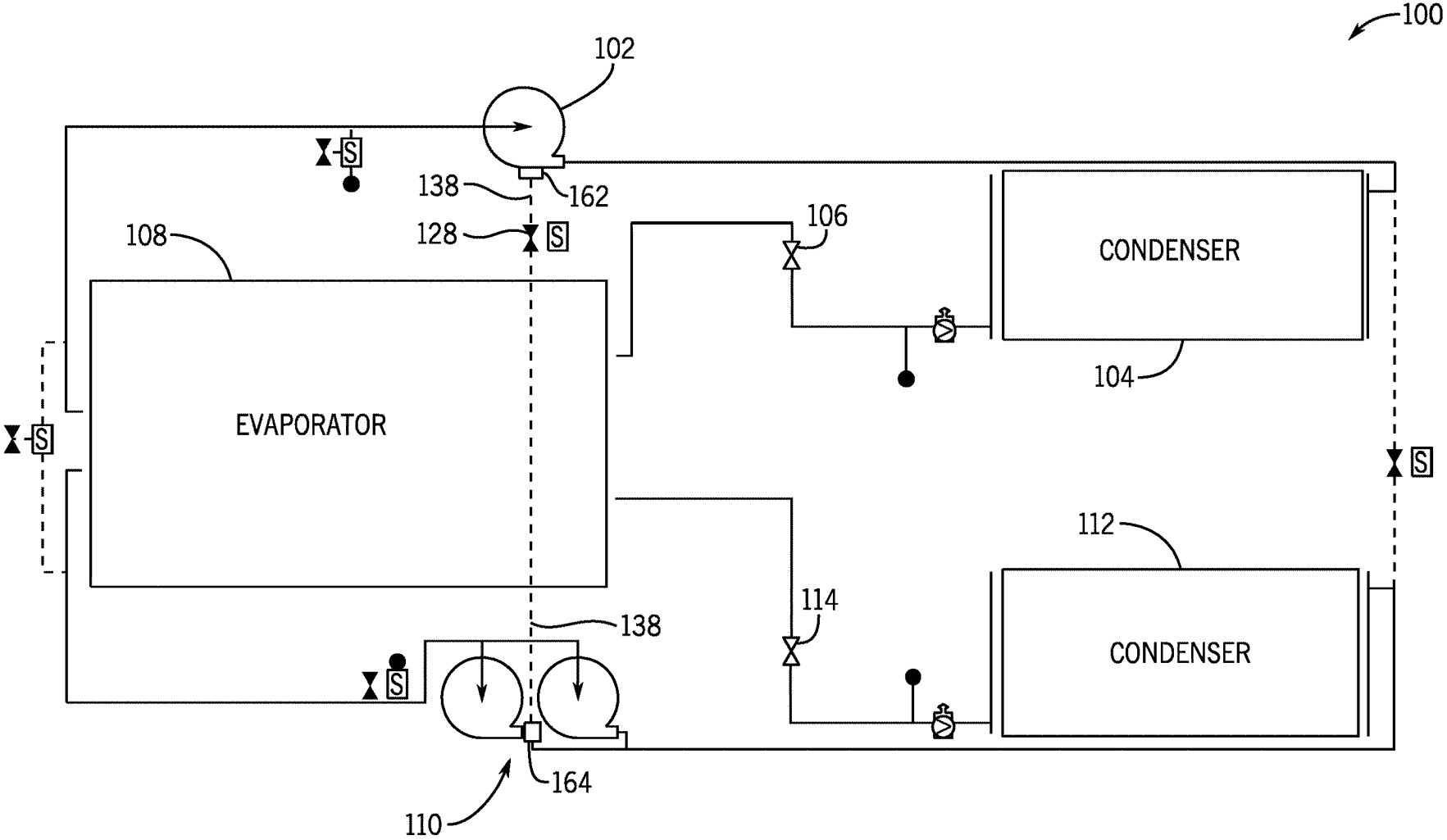
FIG. 8 is a schematic of an embodiment of a multi-circuit HVAC system configured to balance an amount of lubricant between a first circuit and a second circuit of the multi-circuit HVAC system, in accordance with an aspect of the present disclosure.

With the foregoing in mind, the HVAC system may facilitate a transition from a hybrid mode of operation of the multi-circuit system 100 to a conventional mode of operation under full load conditions by balancing the amount of lubricant in the sump of the active compressor and the sump of the inactive compressor in the multi-circuit system 100 before activating the inactive compressor of the multi-circuit system 100 for operation in the conventional mode. As illustrated in FIG. 8, the multi-circuit system 100 may include the valve 128 disposed along the bridging conduit 138 extending between the first compressor 102, which may be the active compressor in the hybrid mode, and the second compressor 110, which may be the inactive compressor in the hybrid mode. The bridging conduit 138 may fluidly couple a sump 162 of the first compressor 102 and a sump 164 of the second compressor 110. Additionally, the sump 162 of the first compressor 102 and the sump 164 of the second compressor 110 may each have one or more sensors for detecting the lubricant level in each respective sump 162 and 164. The lubricant level sensors of the sump 162 and the sump 164 may be communicatively coupled to the control system of the HVAC system. As such, the control system of the HVAC system may receive lubricant level data associated with the sump 162 of the first compressor 102 and the sump 164 of the second compressor 110.

Before activating the second compressor 110, the control system of the HVAC system may compare the lubricant level in the sump 164 of the second compressor 110 with a minimum lubricant threshold. In certain embodiments, the minimum lubricant threshold may correspond to the minimum standard operating condition of the sump 164 of the second compressor 110. In some embodiments, the control system of the HVAC system may receive the minimum lubricant threshold from a database communicatively coupled to the HVAC system, access the minimum lubricant threshold from the memory 88 of the control system, or any other suitable source.

If the control system of the HVAC system determines that the lubricant level in the sump 164 of the second compressor 110 is less than the minimum lubricant threshold, the control system of the HVAC system may send a command signal to the first compressor 102 to deactivate, a command signal to the valve 128 to open, and a command signal to the second compressor 110 to activate. Thereafter, by virtue of the operation of the second compressor 110, at least a portion of the lubricant in the sump 162 of the first compressor 102 may migrate to the sump 164 of the second compressor 110 through open valve 128 via the bridging conduit 138. The lubricant level in the sump 164 may be a first detected lubricant level, and the control system may detect a second lubricant level in the sump 164 at a period in time after the valve 128 has been opened. For example, after the control system determines that the lubricant level in the sump 164 of the second compressor 110 is greater than or equal to the minimum lubricant threshold, the control system of the HVAC system may send a command signal to the valve 128 to close. In certain embodiments, the second compressor 110 may continue to operate to circulate refrigerant through the second circuit after the valve 128 is closed.

Although the above discussion with regard to balancing a lubricant in the multi-circuit system 100 refers to the first compressor 102 as being the active compressor and the second compressor 110 as being the inactive compressor during a hybrid mode operation of the multi-circuit system 100, it should be noted that in other embodiments, the second compressor 110 may be the active compressor, and the first compressor 102 may be the inactive compressor during the hybrid mode operation of the multi-circuit system 100. In such embodiments, if the control system of the HVAC system determines that the lubricant level in the sump 162 of the first compressor 102 is less than the minimum lubricant threshold, the control system of the HVAC system may send a command signal to the second compressor 110 to deactivate, send a command signal to valve 128 to open, and send a command signal to first compressor 102 to activate. Thereafter, by virtue of the operation of the first compressor 102, at least a portion of the lubricant in the sump 164 of the second compressor 110 may migrate to the sump 162 of the first compressor 102 through open valve 128 via the bridging conduit 138. After the control system determines that the lubricant level in the sump 162 of the first compressor 102 is greater than or equal to the minimum lubricant threshold, the control system of the HVAC system may send a command signal to the valve 128 to close. In certain embodiments, the first compressor 102 may continue to operate to circulate refrigerant through the first circuit after the valve 128 is closed.

Figure 9:
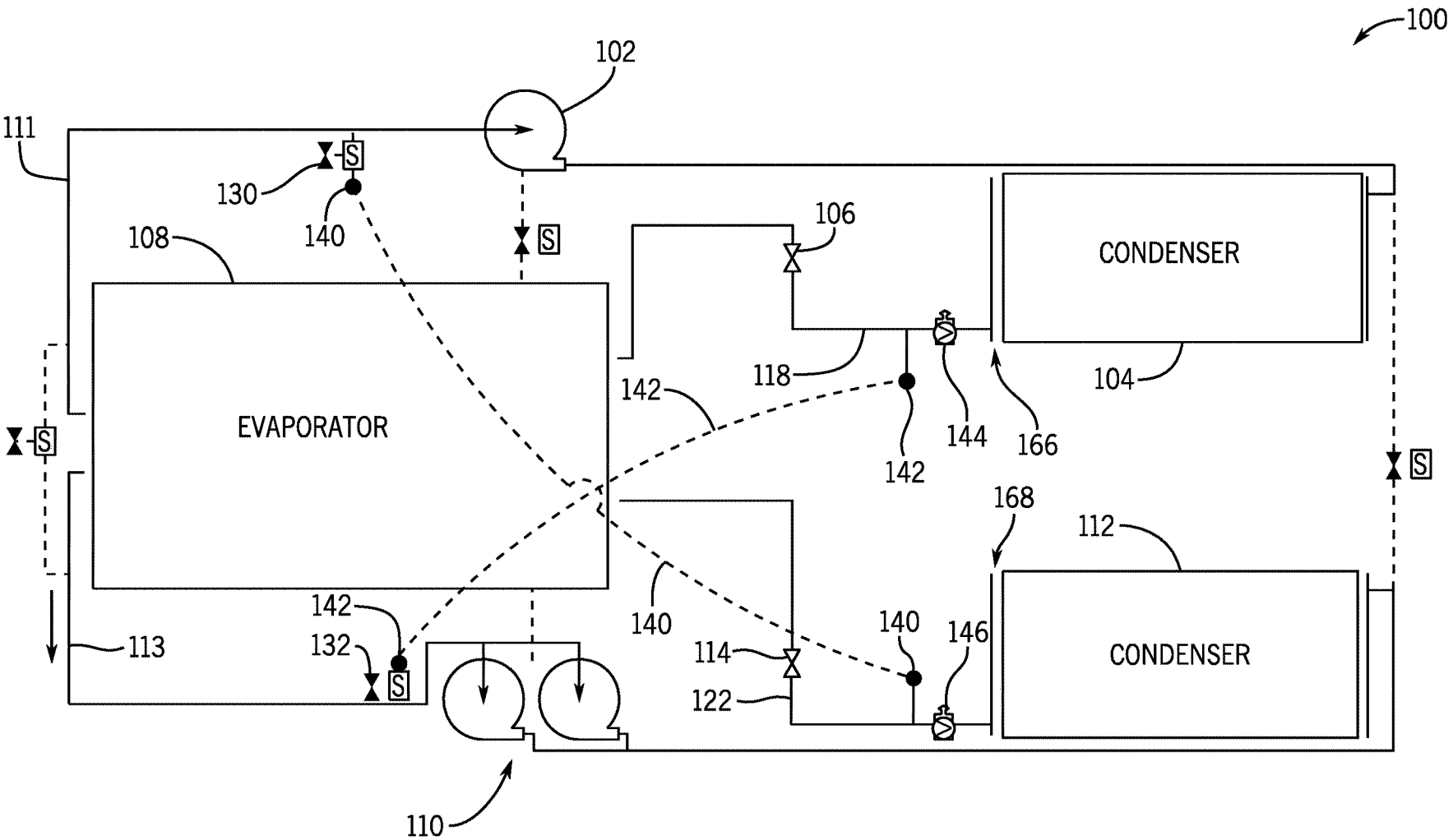
FIG. 9 is a schematic of an embodiment of a multi-circuit HVAC system configured to balance an amount of refrigerant between a first circuit and a second circuit of the multi-circuit HVAC system, in accordance with an aspect of the present disclosure.

Additionally, or alternatively, the HVAC system may facilitate a transition from a hybrid mode of operation of the multi-circuit system 100 to a conventional mode of operation of the multi-circuit system 100 under full load conditions by balancing the amount of refrigerant in the active circuit and the inactive circuit in the multi-circuit system 100. As illustrated in FIG. 9, the multi-circuit system 100 may include the valve 132 disposed along the bridging conduit 142 between the first circuit, or the active circuit, and the second circuit, or the inactive circuit. The bridging conduit 142 may fluidly couple the discharge conduit 113 upstream of the second compressor 110 and the discharge conduit 118 downstream of the first condenser 104. In addition, the second temperature sensor 146, such as a thermocouple, may be disposed at or near the refrigerant exit 168 of the second condenser 112 for measuring an amount of subcooling of the refrigerant at or near the refrigerant exit 168 of the second condenser 112. In certain embodiments, the second temperature sensor 146 may be positioned along the discharge conduit 122 downstream of the second condenser 112 and upstream of the second expansion device 114. The second temperature sensor 146 may be communicatively coupled to the control system of the HVAC system. As such, the control system of the HVAC system may receive refrigerant subcooling data associated with the refrigerant in the second circuit.

Before operating the multi-circuit system 100 in the conventional mode of operation under full load conditions, the control system of the HVAC system may compare an amount of subcooling of the refrigerant in the second circuit with a reference subcooling threshold after the first compressor 102 has been deactivated and the second compressor 110 has been activated after the second compressor 110 was inactive during the hybrid mode of operation. The control system of the HVAC system may deactivate the first compressor 102 and activate the second compressor 110 to circulate the refrigerant through the second circuit to provide an accurate measurement of the refrigerant subcooling in the second circuit with the existing refrigerant in the second circuit. In certain embodiments, the reference subcooling threshold may correspond to the standard amount of subcooling during a conventional mode operation of the second circuit. The standard amount of subcooling may correspond to a desired amount or a desired range of refrigerant subcooling that may facilitate circulation of the refrigerant through the second expansion device 114 without forming vapor bubbles in the refrigerant. For example, vapor bubbles in the refrigerant may cause low refrigerant flow which, in turn, may cause a loss of capacity and efficiency in a cooling system. In some embodiments, the control system may receive the reference subcooling threshold from a database communicatively coupled to the HVAC system, access the reference subcooling threshold from the memory 88 of the control system, or any other suitable source.

If the control system determines that the amount of refrigerant subcooling of the second circuit is less than the reference subcooling threshold, the control system may send a command signal to valve 132 to open. Thereafter, by virtue of the operation of the second compressor 110, at least a portion of the refrigerant from the first circuit will mobilize to the second circuit through open valve 132 via the bridging conduit 142. After the control system determines that the amount of refrigerant subcooling of the second circuit is greater than or equal to the reference subcooling threshold, the control system of the HVAC system may send a signal to valve 132 to close. As such, the control system of the HVAC system may balance the amount of refrigerant between the two circuits such that a sufficient or adequate amount of subcooling is available in the second circuit to operate in conventional mode under full load conditions after operating in part load conditions.

Although the above discussion with regard to balancing an amount of refrigerant in the multi-circuit system 100 refers to the first circuit as the active circuit and the second circuit as the inactive circuit during a hybrid mode of operation of the multi-circuit system 100, it should be noted that in other embodiments the second circuit may be the active circuit, and the first circuit may be the inactive circuit during a hybrid mode of operation of the multi-circuit system 100. In such embodiments, the multi-circuit system 100 may include the valve 130 disposed along the bridging conduit 140 between the first circuit and the second circuit. The bridging conduit 140 may fluidly couple the discharge conduit 111 upstream of the first compressor 102 and the discharge conduit 122 downstream of the second condenser 112. In addition, the first temperature sensor 144, such as a thermocouple, may be disposed at or near the refrigerant exit 166 of the first condenser 104 for measuring an amount of subcooling of the refrigerant at or near the refrigerant exit 166 of the first condenser 104. In certain embodiments, the first temperature sensor 144 may be positioned along the discharge conduit 118 downstream of the first condenser 104 and upstream of the first expansion device 106. The first temperature sensor 144 may be communicatively coupled to the control system of the HVAC system. As such, the control system may receive refrigerant subcooling data associated with the refrigerant in the first circuit.

Before operating the multi-circuit system 100 in the conventional mode of operation under full load conditions, the control system of the HVAC system may compare an amount of subcooling of the refrigerant in the first circuit with a reference subcooling threshold after the second compressor 110 has been deactivated and the first compressor 102 has been activated after the first compressor 102 was inactive during the hybrid mode of operation. The control system of the HVAC system may deactivate the second compressor 110 and activate the first compressor 102 to circulate the refrigerant through the first circuit to provide an accurate measurement of the refrigerant subcooling in the first circuit. In certain embodiments, the reference subcooling threshold may correspond to the standard amount of subcooling during a conventional mode of operation of the first circuit. In some embodiments, the control system may receive the reference subcooling threshold from a database communicatively coupled to the HVAC system, access the reference subcooling threshold from the memory 88 of the control system, or any other suitable source.

If the control system determines that the amount of refrigerant subcooling of the first circuit is less than the reference subcooling threshold, the control system may send a command signal to valve 130 to open. Thereafter, by virtue of the operation of the first compressor 102, at least a portion of the refrigerant from the second circuit will mobilize to the first circuit through open valve 130 via the bridging conduit 140. After the control system determines that the amount of refrigerant subcooling of the first circuit is greater than or equal to the reference subcooling threshold, the control system may send a command signal to valve 130 to close. As such, the control system of the HVAC system may balance the amount of refrigerant between the two circuits such that a sufficient or adequate amount of subcooling is available in the first circuit to operate in conventional mode under full load conditions after operating in part load conditions.

Figure 10:
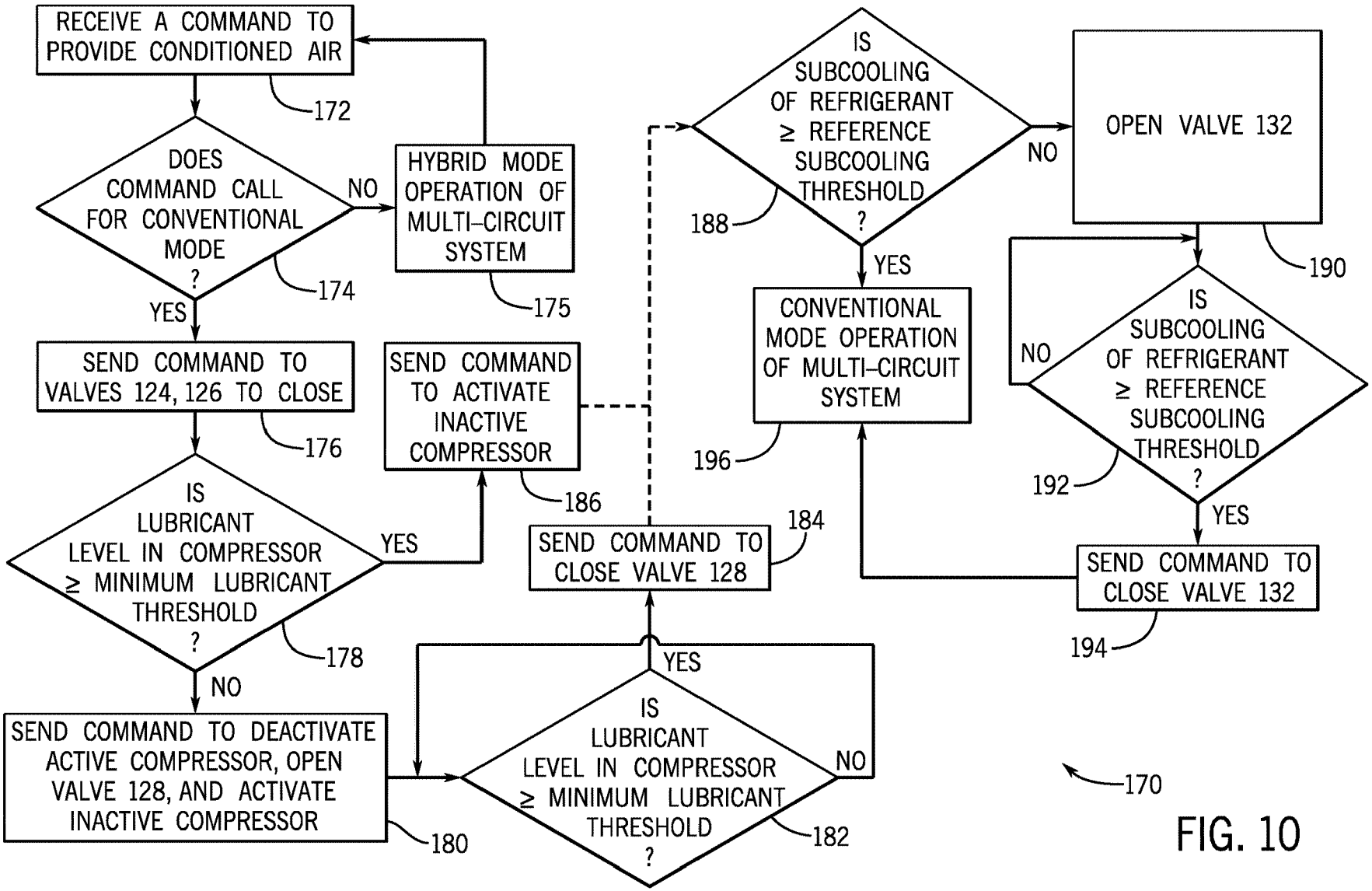
FIG. 10 is a flowchart of a method of transitioning between a hybrid mode of a multi-circuit HVAC system to a conventional mode of the multi-circuit HVAC system under full load conditions, in accordance with an aspect of the present disclosure.

With the foregoing in mind, FIG. 10 illustrates a flow chart of a method 170 of transitioning between a hybrid mode of operation of the multi-circuit system 100 to a conventional mode of operation under full load conditions based on a command received by the HVAC system to provide conditioned air to a space, such as a building or a room. Although the following description of the method 170 is described in a particular order, it should be noted that the method 170 is not limited to the depicted order, and instead, the method 170 may be performed in any suitable order. In certain embodiments, the control system of the HVAC system may perform the steps of method 170 at blocks 174 to 186, or perform the steps of method 170 at blocks 188 to 196, but not both. For example, the control system may determine to balance a lubricant between the sump 162 of the first compressor 102 and the sump 164 of the second compressor 110 without determining to balance a refrigerant between the first circuit and the second circuit, or vice versa. Moreover, although the method 170 is described as being performed by a control system of the HVAC system, it should be noted that it may be performed by the control device 16 shown in FIG. 1, the control board 48 shown in FIG. 2, the control panel 82 shown in FIG. 4, or any other suitable device. For example, the control system of the HVAC system may include microprocessor 86 and memory 88 of the control panel 82. The microprocessor 86 may be used to execute software, such as software for providing commands and/or data to the control system, and so forth. Additionally, the microprocessor 86 may include multiple microprocessors, one or more "general-purpose" microprocessors, one or more special-purpose microprocessors, and/or one or more application specific integrated circuits (ASICS), or some combination thereof. The memory 88 may include a volatile memory, such as RAM, and/or a nonvolatile memory, such as ROM. The memory 88 may store a variety of information and may be used for various purposes. For example, the memory 88 may store processor-executable instructions for the microprocessor 86 to execute, such as instructions for providing commands and/or data to the control system.

By way of example, the description with regard to the method 170 is made with reference to the active circuit as the first circuit with the first compressor 102 and the inactive circuit as the second circuit with the second compressor 110 as a result of hybrid mode operation of the multi-circuit system 100. However, it should be noted that the description is a non-limiting example, and the active circuit may be the second circuit with the second compressor 110, and the inactive circuit may be the first circuit with the first compressor 102 as a result of hybrid mode operation of the multi-circuit system 100.

Referring now to FIG. 10, at block 172, the control system of the HVAC system may receive a command to provide conditioned air to a space, such as a room or a building. For example, a user may input a command to adjust the temperature of a room or a building to a desired temperature into a system controller or a thermostat of the HVAC system while the multi-circuit system 100 is operating in hybrid mode. At block 174, the control system may determine whether the multi-circuit system 100 should continue operating in the hybrid mode or should operate in the conventional mode under full load conditions, based on the command received at block 172. In one embodiment, the control system may determine that the multi-circuit system 100 may operate in the hybrid mode or the conventional mode based on a corresponding amount of conditioned air or a corresponding temperature of the conditioned air that is to be provided to the space based on the command.

Upon determining that the multi-circuit system 100 should continue operating in hybrid mode based on the received input, as indicated at block 175, the control system may continue operating the multi-circuit system 100 in the hybrid mode. Upon determining that the multi-circuit system 100 should operate in conventional mode based on the received input, as indicated at block 176, the control system may send a command signal to valves 124 and 126 to close. As described above, the valves 124 and 126 may be open to facilitate operation of the multi-circuit system 100 in the hybrid mode.

At block 178, the control system may determine whether the lubricant level in the sump 164 of the second, inactive compressor 110 is greater than or equal to a minimum lubricant threshold. As described above, the control system may receive lubricant level data from one or more lubricant level sensors in the sump 164 of the second compressor 110. The control system may then compare the lubricant level in the sump 164 of the second compressor 110 with the minimum lubricant threshold, which may correspond to the minimum standard operating conditions of the sump 164 of the second compressor 110.

At block 180, if the control system determines that the lubricant level in the sump 164 of the second compressor 110 is less than the minimum lubricant threshold, the control system may send a command signal to the first compressor 102 to deactivate, send a command signal to valve 128 to open, and send a command signal to the second compressor 110 to activate. Thereafter, by virtue of the operation of the second compressor 110, at least a portion of the lubricant in the sump 162 of the first compressor 102 may migrate to the sump 164 of the second compressor 110 through open valve 128 via the bridging conduit 138. At block 182, the control system may determine whether the lubricant level in the sump 164 of the second compressor 110 is greater than or equal to a minimum lubricant threshold. For example, the control system may compare lubricant level data received from the sensors in the sump 164 of the second compressor 110 continuously or intermittently with the minimum lubricant threshold as lubricant migrates from the sump of the first compressor 102 to the second compressor 110. At block 184, after the control system determines that the lubricant level in the sump 164 of the second compressor 110 is greater than or equal to the minimum lubricant threshold, the control system may close the valve 128. The control system may then proceed to the steps of method 170 at blocks 188 to 196.

Referring back to block 178, the control system may determine that the lubricant level in the sump 164 of the second compressor 110 is greater than or equal to the minimum lubricant threshold. As such, the control system may activate the second compressor 110 and proceed to the steps of method 170 at blocks 188 to 196.

At block 188, the control system may compare an amount of refrigerant subcooling in the second circuit with a reference subcooling threshold after the second compressor 110 has been activated for the conventional mode of operation. The reference subcooling threshold may correspond to the standard amount of subcooling during a conventional mode of operation of the second circuit. For example, the control system may receive refrigerant subcooling data received from the second temperature sensor 146 and compare the refrigerant subcooling data to the reference subcooling threshold. At block 190, after the control system determines that the amount of refrigerant subcooling of the second circuit is less than the reference subcooling threshold, the control system may send a command signal to valve 132 to open, as described above. In certain embodiments, the first compressor 102 and the second compressor 110 are both active. For example, referring back to block 186, the control system may send a signal to activate the second compressor 110 while the first compressor 102 is operating. In such embodiments, the control system may also send a command signal to the first compressor 102 to deactivate. Thereafter, by virtue of the operation of the second compressor 110, at least a portion of the refrigerant from the first circuit will mobilize to the second circuit through open valve 132 via the bridging conduit 142.

At block 192, the control system may determine whether the amount of refrigerant subcooling of the second circuit is greater than or equal to the reference subcooling threshold. For example, the control system may compare refrigerant subcooling data received from the second temperature sensor 146 continuously or intermittently with the reference subcooling threshold as refrigerant migrates from the first circuit to the second circuit. At block 194, after the control system determines that the amount of refrigerant subcooling of the second circuit is greater than or equal to the minimum lubricant threshold, the control system may send a command to valve 132 to close. Thereafter, at block 196, the control system may operate the multi-circuit system 100 in the conventional mode under full load conditions.

Referring back to block 188, the control system may determine that the amount of refrigerant subcooling of the second circuit is greater than or equal to the reference subcooling threshold. As such, at block 196, the control system may operate the multi-circuit system 100 in the conventional mode under full load conditions.

In certain embodiments, the HVAC system may facilitate a transition in the operation of the multi-circuit system 100 from hybrid mode to conventional mode under part load conditions in response to one or more operational conditions associated with the multi-circuit system 100. That is, the multi-circuit system 100 may transition from a hybrid mode of operation to an operation utilizing only the heat transfer area of the first circuit or the second circuit based on one or more operational conditions determined by the control system.

A decrease in the temperature of the surrounding ambient air, for example to approximately less than 50° F., may cause a decrease in the head pressure of an active compressor. Additionally, or alternatively, a low amount of refrigerant in an active circuit may also cause a decrease in the head pressure of the active compressor. In any case, a decrease in head pressure of an active compressor may reduce the cooling capacity of the multi-circuit system 100 in the hybrid mode and may decrease a power efficiency of the multi-circuit system 100. As such, the control system may compare the head pressure of an active compressor to a threshold pressure to determine whether to transition an operation of the multi-circuit system 100 from hybrid mode to conventional mode.

Figure 11:
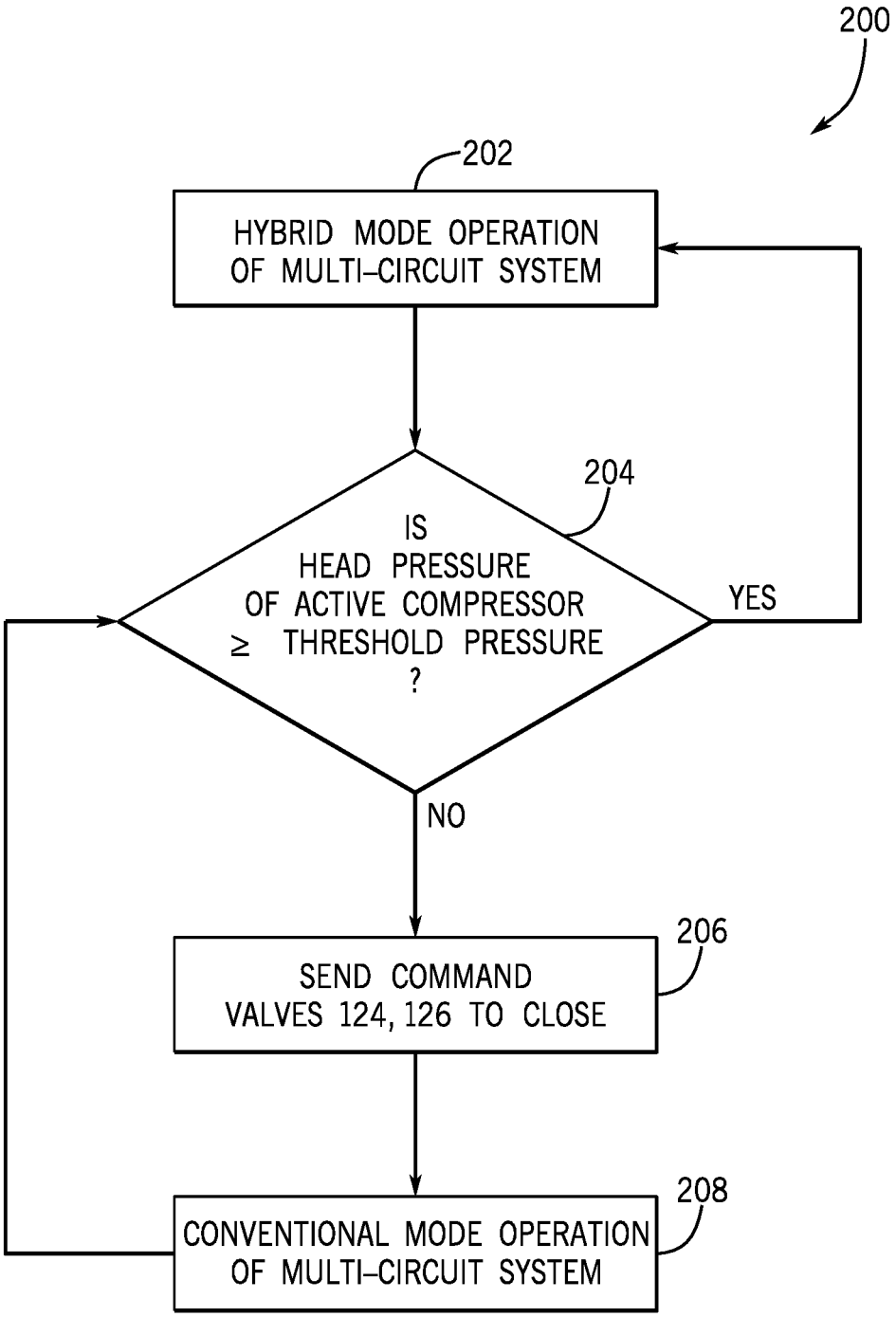
FIG. 11 is a flowchart of a method of transitioning between a hybrid mode of a multi-circuit HVAC system to a conventional mode of the multi-circuit HVAC system under part load conditions, in accordance with an aspect of the present disclosure.

With the foregoing in mind, FIG. 11 illustrates a flow chart of a method 200 for transitioning between a hybrid mode of operation of the multi-circuit system 100 to a conventional mode of operation of the multi-circuit system 100 under part load conditions based on a determination that the head pressure of an active compressor has dropped below a pressure threshold. Although the following description of the method 200 is described in a particular order, it should be noted that the method 200 is not limited to the depicted order, and instead, the method 200 may be performed in any suitable order. Moreover, although the method 200 is described as being performed by a control system of the HVAC system, it should be noted that it may be performed by the control device 16 shown in FIG. 1, the control board 48 shown in FIG. 2, the control panel 82 shown in FIG. 4, or any other suitable device. For example, the control system of the HVAC system may include microprocessor 86 and memory 88 of the control panel 82. The microprocessor 86 may be used to execute software, such as software for providing commands and/or data to the control system, and so forth. Additionally, the microprocessor 86 may include multiple microprocessors, one or more "general-purpose" microprocessors, one or more special-purpose microprocessors, and/or one or more application specific integrated circuits (ASICS), or some combination thereof. The memory 88 may include a volatile memory, such as RAM, and/or a nonvolatile memory, such as ROM. The memory 88 may store a variety of information and may be used for various purposes. For example, the memory 88 may store processor-executable instructions for the microprocessor 86 to execute, such as instructions for providing commands and/or data to the control system.

Referring now to FIG. 11, at block 202, the multi-circuit system 100 may operate in the hybrid mode. For example, as described above, the control system may receive a command to provide conditioned air to a space, such as a room or a building, and determine that the multi-circuit system 100 should operate in the hybrid mode under part load conditions based on the command. In the hybrid mode, the first compressor 102 may be the active compressor, and the second compressor 110 may be the inactive compressor, or vice versa, as described above. At block 204, the control system may determine whether the head pressure of the active compressor is greater than or equal to a threshold pressure. In certain embodiments, the threshold pressure may be a reference pressure based on a desired power efficiency, a desired cooling efficiency, or a standard operating pressure for a hybrid mode operation of the multi-circuit system 100. In one embodiment, the threshold pressure may be substantially equal to 250 PSIG. The control system may receive the threshold pressure from a database communicatively coupled to the HVAC system, access the threshold pressure from the memory 88 of the control system, or any other suitable source.

At block 206, after the control system determines that the head pressure of the active compressor is less than a threshold pressure, the control system may send a command signal to valves 124 and 126 to close. After valves 124, 126 are closed, the active compressor may circulate refrigerant the circuit with which it is associated, as described above, thereby utilizing the heat transfer area of that circuit. As such, at block 208, the multi-circuit system 100 may operate in conventional mode under part load conditions in response to a determination that the head pressure of the active compressor is less than a threshold pressure.

In certain embodiments, the control system may perform the steps of the method 170 at blocks 178 to 194, as described with reference to FIG. 10, before operating the multi-circuit system 100 in conventional mode. By balancing the lubricant between the sump 162 of the first compressor 102 and the sump 164 of the second compressor 110 and by balancing the refrigerant between the first circuit and the second circuit, the control system of the HVAC system may facilitate a conventional mode of operation at least at standard operating conditions of the first circuit, the second circuit, or both.

Additionally, or alternatively, the control system of the HVAC system may determine to transition the operation of the multi-circuit system 100 from a hybrid mode of operation to a conventional mode of operation after determining that the amount of subcooling of the refrigerant in one of the circuits is less than a reference subcooling threshold. For example, loss of refrigerant in a first circuit of the multi-circuit system 100 may result in a decreased amount of subcooling of the refrigerant in the first circuit. As such, it may be desirable to maintain the operation of the second circuit of the multi-circuit system 100 without the refrigerant loss while providing an alarm or notification that the subcooling of the refrigerant is lower than normal in the first circuit.

Figure 12:
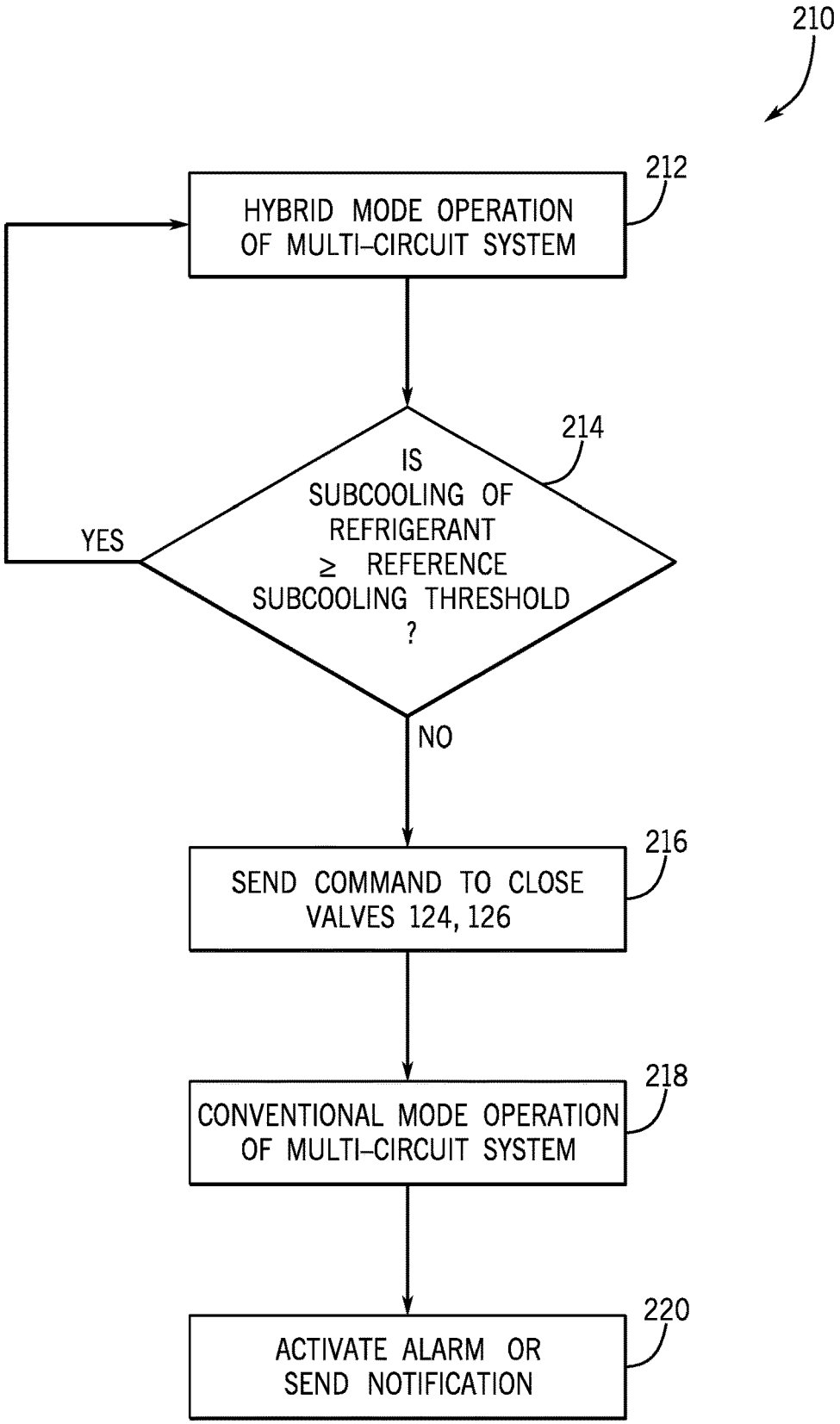
FIG. 12 is a flowchart of a method of transitioning between a hybrid mode of a multi-circuit HVAC system to a conventional mode of operation of the multi-circuit system under part load conditions, in accordance with an aspect of the present disclosure.

With the foregoing in mind, FIG. 12 illustrates a flow chart of a method 210 for transitioning between a hybrid mode of operation of the multi-circuit system 100 to a conventional mode of operation of the multi-circuit system 100 under part load conditions based on a determination that the subcooling of the refrigerant in the hybrid circuit is less than a reference subcooling threshold. Although the following description of the method 210 is described in a particular order, it should be noted that the method 210 is not limited to the depicted order, and instead, the method 210 may be performed in any suitable order. Moreover, although the method 210 is described as being performed by a control system of the HVAC system, it should be noted that it may be performed by the control device 16 shown in FIG. 1, the control board 48 shown in FIG. 2, the control panel 82 shown in FIG. 4, or any other suitable device. For example, the control system of the HVAC system may include microprocessor 86 and memory 88 of the control panel 82. The microprocessor 86 may be used to execute software, such as software for providing commands and/or data to the control system, and so forth. Additionally, the microprocessor 86 may include multiple microprocessors, one or more "general-purpose" microprocessors, one or more special-purpose microprocessors, and/or one or more application specific integrated circuits (ASICS), or some combination thereof. The memory 88 may include a volatile memory, such as RAM, and/or a nonvolatile memory, such as ROM. The memory 88 may store a variety of information and may be used for various purposes. For example, the memory 88 may store processor-executable instructions for the microprocessor 86 to execute, such as instructions for providing commands and/or data to the control system.

Referring now to FIG. 12, at block 212, the multi-circuit system 100 may operate in the hybrid mode of operation. For example, as described above, the control system may receive a command to provide conditioned air to a space, such as a room or a building, and may determine that the multi-circuit system 100 should operate in the hybrid mode under part load conditions based on the command. At block 214, the control system may compare an amount of subcooling of the refrigerant in the hybrid circuit with a reference subcooling threshold. The reference subcooling threshold may correspond to the standard amount of subcooling during a hybrid mode operation of the multi-circuit system 100. The standard amount of subcooling may correspond to a desired amount or a desired range of refrigerant subcooling that may facilitate circulation of the refrigerant through the first expansion device 106 and the second expansion device 114 without forming vapor bubbles in the refrigerant, which may be indicative of an acceptable efficiency level of operation of the HVAC system.

In some embodiments, the control system may receive refrigerant subcooling data from the first temperature sensor 144 and the second temperature sensor 146. The control system may then compare the refrigerant subcooling data from both temperature sensors 144 and 146 to the reference subcooling threshold for a hybrid mode of operation of the multi-circuit system 100 with the first compressor 102 as the active compressor. In one embodiment, a first reference subcooling threshold may be associated with the first temperature sensor 144 during the hybrid mode of operation of the multi-circuit system 100, and a second reference subcooling threshold may be associated with the second temperature sensor 146 during the hybrid mode of operation of the multi-circuit system 100. The control system may then determine whether the amount of refrigerant subcooling of the hybrid circuit is less than the reference subcooling threshold based on a first comparison between the refrigerant subcooling data from the first temperature sensor 144 to the first reference subcooling threshold, a second comparison between the refrigerant subcooling data from the second temperature sensor 146 to the second reference subcooling threshold, or both. In another embodiment, the refrigerant subcooling data from the first temperature sensor 144 and the refrigerant subcooling data from the second temperature sensor 146 may be averaged, and the average may be compared to a reference subcooling threshold associated with the hybrid mode of operation of the multi-circuit system 100.

In any case, at block 216, if the control system determines that the amount of refrigerant subcooling of the hybrid circuit is less than the reference subcooling threshold, the control system may send a command signal to valves 124 and 126 to close, as described above. After valves 124 and 126 are closed, the first compressor 102 may circulate refrigerant through the first circuit, as described above, thereby utilizing the heat transfer area of the first circuit and without utilizing any heat transfer area from the second circuit. As such, at block 218, the multi-circuit system 100 may operate in the conventional mode of operation under part load conditions. At block 220, the control system may also activate an alarm or send a notification of a decrease in subcooling in the hybrid circuit to a display communicatively coupled to the control system. For example, the control system may send a notification indicative of insufficient or inadequate subcooling to a thermostat having a display.

Referring back to block 214, the control system may determine that the amount of refrigerant subcooling of the hybrid circuit is greater than or equal to the reference subcooling threshold. As such, the control system of the HVAC system may continue operating the multi-circuit system 100 in the hybrid mode of operation.

In certain embodiments, the control system may compare an amount of subcooling of the refrigerant in each circuit of the multi-circuit system 100 regardless of the operational mode. That is, the control system may continuously or intermittently compare the amount of refrigerant subcooling in the first circuit or the second circuit to a respective reference subcooling threshold for the first circuit or the second circuit during a conventional mode operation of the multi-circuit system 100 under part load conditions, compare the amount of refrigerant subcooling in the hybrid circuit to a respective reference subcooling threshold for the hybrid circuit of the multi-circuit system 100, or compare the amount of refrigerant subcooling in the first circuit and the second circuit to a respective reference subcooling threshold for the first circuit and the second circuit during a conventional mode operation of the multi-circuit system 100 under full load conditions. As such, the control system of the HVAC system may transition the operation of the multi-circuit system 100 from hybrid mode or conventional mode under full load conditions to conventional mode under part load conditions in order to utilize a circuit that has sufficient refrigerant subcooling.

As set forth above, embodiments of the present disclosure may provide one or more technical effects increasing a heat transfer efficiency and a net cooling capacity of a multi-circuit system 100 by operating in a hybrid mode such that refrigerant-sharing occurs between portions of the first and second refrigeration circuits as compared to a conventional mode of operation of the multi-circuit system 100 under part load conditions. The hybrid mode of operation of the multi-circuit system 100 may also decrease the power consumption of an active compressor by providing additional heat transfer area to the active circuit as compared to the power consumption of an active compressor during a conventional mode of operation of the multi-circuit system 100. Additionally, the HVAC system may balance an amount of lubricant, an amount of refrigerant, or both between each circuit in the multi-circuit system 100, such that each circuit has at least a sufficient or adequate amount of refrigerant and at least a sufficient or adequate amount of lubricant to operate in the conventional mode under full load conditions. Further, the HVAC system may transition operation of the multi-circuit system from hybrid mode to conventional mode to maintain operation of at least one circuit of the multi-circuit system in response to one or more operational conditions associated with the multi-circuit system 100. The operation conditions, for example, may include a decrease in the head pressure of the active compressor or refrigerant loss in a circuit of the multi-circuit system 100. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a first refrigeration circuit having a first compressor and a first condenser, wherein the first compressor is configured to urge refrigerant in the first refrigeration circuit in a direction upstream to downstream in the first refrigeration circuit;

a second refrigeration circuit having a second compressor and a second condenser, wherein the second compressor is configured to urge refrigerant in the second refrigeration circuit in a direction upstream to downstream in the second refrigeration circuit;

a conduit extending from a portion of the first refrigeration circuit that is downstream of the first condenser to a portion of the second refrigeration circuit that is upstream of the second compressor;

a valve disposed along the conduit and configured to manage refrigerant flow therethrough; and a controller configured to operate the HVAC system in a first mode such that the first refrigeration circuit separately circulates the refrigerant in the first refrigeration circuit and the second refrigeration circuit separately circulates the refrigerant in the second refrigeration circuit, and configured to transition to a second mode such that refrigerant-sharing occurs between portions of the first and second refrigeration circuits, wherein, in response to a request to transition from the second mode to the first mode, the controller is configured to:

determine an amount of subcooling of refrigerant downstream of the second condenser;

compare the amount of subcooling to a threshold value of subcooling associated with the first mode; and instruct opening of the valve upon a determination that the amount of subcooling is less than the threshold value of subcooling associated with the first mode.

2. The HVAC system of claim 1, wherein the controller is configured to:

operate the first compressor and suspend operation of the second compressor during the second mode;

activate the second compressor after receiving the request to transition from the second mode to the first mode and prior to determining the amount of subcooling; and deactivate the first compressor after receiving the request to transition from the second mode to the first mode and after the determination that the amount of subcooling is less than the threshold value of subcooling associated with the first mode.

3. The HVAC system of claim 2, wherein the amount of subcooling is a first amount of subcooling, and wherein the controller is configured to:

determine a second amount of subcooling of refrigerant downstream of the second condenser after activating the second compressor;

compare the second amount of subcooling of refrigerant to the threshold value of subcooling; and instruct closing of the valve upon a determination that the second amount of subcooling is greater than or equal to the threshold value of subcooling associated with the first mode.

4. The HVAC system of claim 3, wherein the controller is configured to activate the first compressor after instructing closing of the valve.

5. The HVAC system of claim 1, wherein the controller is configured to operate the first compressor and suspend operation of the second compressor during the second mode and, after receiving the request to transition from the second mode to the first mode:

detect a lubricant level in a second sump of the second compressor;

compare the lubricant level to a threshold value of lubricant associated with the first mode; and instruct opening of a lubricant valve disposed along a lubricant conduit extending between the second sump a first sump of the first compressor upon a determination that the lubricant level is less than the threshold value of lubricant.

6. The HVAC system of claim 5, wherein the controller is configured to:

deactivate the first compressor after comparing the lubricant level to the threshold value of lubricant and prior to instructing opening of the lubricant valve; and activate the second compressor after instructing opening of the lubricant valve.

7. The HVAC system of claim 6, wherein the lubricant level in the second sump is a first lubricant level, and wherein the controller is configured to, after activating the second compressor:

detect a second lubricant level in the second sump;

compare the second lubricant level to the threshold value of lubricant; and instruct closing of the lubricant valve upon a determination that the second lubricant level is greater than or equal to the threshold value of lubricant.

8. The HVAC system of claim 5, wherein the controller is configured to activate the second compressor upon a determination that the lubricant level is equal to or greater than the threshold value of lubricant.

9. The HVAC system of claim 1, wherein the controller is configured to, before receiving the request to transition from the second mode to the first mode:

initiate operation of the HVAC system in the second mode based on a command to provide conditioned air to a building.

10. The HVAC system of claim 9, further comprising:

a first bridging conduit extending from a portion of the first refrigeration circuit that is downstream of an evaporator to a portion of the second refrigeration circuit that is downstream of the evaporator; and a second bridging conduit extending from a portion of the first refrigeration circuit that is upstream of the first condenser to a portion of the second refrigeration circuit that is upstream of the second condenser, wherein, to initiate operation of the HVAC system in the second mode, the controller is configured to:

instruct opening of a first bridging valve disposed along the first bridging conduit;

instruct opening of a second bridging valve disposed along the second bridging conduit; and activate the first compressor of the first refrigeration circuit.

11. The HVAC system of claim 1, wherein the controller comprises a plurality of separate controller devices.

12. A control system configured to control climate characteristics in a building via a multi-circuit system including a first refrigeration circuit having a first compressor and a first condenser, wherein the first compressor is configured to urge refrigerant in the first refrigeration circuit in a direction upstream to downstream in the first refrigeration circuit, and having a second refrigeration circuit having a second compressor and a second condenser, wherein the second compressor is configured to urge refrigerant in the second refrigeration circuit in a direction upstream to downstream in the second refrigeration circuit, the first and second refrigeration circuits sharing an evaporator, wherein the control system comprises a controller configured to:

receive a first command to transition operation of the multi-circuit system to a first mode of operation, in which the first and second refrigeration circuits operate separately, from a second mode of operation, in which refrigerant-sharing occurs between portions of the first and second refrigeration circuits;

determine an amount of subcooling of refrigerant downstream of the second condenser;

compare the amount of subcooling of refrigerant to a threshold value of subcooling associated with the first mode of operation; and send a second command to open a valve to facilitate refrigerant flow along a conduit extending from a portion of the first refrigeration circuit downstream of the first condenser to a portion of the second refrigeration circuit upstream of the second compressor upon a determination that the amount of subcooling is less than the threshold value of subcooling.

13. The control system of claim 12, wherein the controller is configured to:

operate the first compressor and suspend operation of the second compressor in the second mode;

activate the second compressor after receiving the first command and prior to determining the amount of subcooling; and deactivate the first compressor after receiving the first command and after the determination that the amount of subcooling is less than the threshold value of subcooling.

14. The control system of claim 13, wherein the amount of subcooling is a first amount of subcooling, and wherein the controller is configured to:

determine a second amount of subcooling of refrigerant downstream of the second condenser after activating the second compressor;

compare the second amount of subcooling of refrigerant to the threshold value of subcooling; and send a third command to close the valve to block refrigerant flow along the conduit upon a determination that the second amount of subcooling is greater than or equal to the threshold value of subcooling.

15. The control system of claim 12, further comprising a lubricant conduit extending from a first sump of the first compressor to a second sump of the second compressor, wherein controller is configured to operate the first compressor and suspend operation of the second compressor during the second mode of operation and, after receiving the first command:

detect a lubricant level in the second sump;

compare the lubricant level to a threshold value of lubricant; and send a third command to open a lubricant valve disposed along the lubricant conduit upon a determination that the lubricant level is less than the threshold value of lubricant.

16. The control system of claim 15, wherein the controller is configured to:

deactivate the first compressor after comparing the lubricant level to the threshold value of lubricant and prior to sending the third command to open the lubricant valve; and activate the second compressor of the second refrigeration circuit after sending the third command to open the lubricant valve.

17. The control system of claim 16, wherein the lubricant level in the second sump is a first lubricant level, and wherein the controller is configured to, after activating the second compressor:

detect a second lubricant level in the second sump;

compare the second lubricant level to the threshold value of lubricant; and send a fourth command to close the lubricant valve upon a determination that the lubricant level is greater than or equal to the threshold value of lubricant.

18. The control system of claim 15, wherein the controller is configured to activate the second compressor upon a determination that the lubricant level is equal to or greater than the threshold value of lubricant.

19. The control system of claim 12, wherein the controller is configured to, before receiving the first command:

receive a third command to provide conditioned air to the building; and adjust the operation of the multi-circuit system to the first mode of operation based on the third command.

20. A control system configured to control climate characteristics in a building via a multi-circuit system including a first refrigeration circuit having a first compressor and a first condenser, wherein the first compressor is configured to urge refrigerant in the first refrigeration circuit in a direction upstream to downstream in the first refrigeration circuit, and having a second refrigeration circuit having a second compressor and a second condenser, wherein the second compressor is configured to urge refrigerant in the second refrigeration circuit in a direction upstream to downstream in the second refrigeration circuit, the first and second refrigeration circuits sharing an evaporator, wherein the control system comprises a controller configured to:

receive a first command to transition operation of the multi-circuit system from a hybrid operation to a conventional operation;

detect a lubricant level in a second sump of the second compressor;

compare the lubricant level to a threshold value of lubricant associated with the conventional operation;

determine that the lubricant level is less than the threshold value of lubricant;

send a second command to open a lubricant valve disposed along a lubricant conduit that extends from the second sump to a first sump of the first compressor;

determine an amount of subcooling of refrigerant downstream of the second condenser;

compare the amount of subcooling of refrigerant to a threshold value of subcooling associated with the conventional operation;

determine that the amount of subcooling is less than the threshold value of subcooling; and send a third command to open a refrigerant valve disposed along a refrigerant conduit extending from a first portion of the first refrigeration circuit that is downstream of the first condenser to a second portion of the second refrigeration circuit that is upstream of the second compressor.

21. The control system of claim 20, wherein the controller is configured to:

operate the first compressor and suspend operation of the second compressor during the hybrid operation;

deactivate the first compressor after comparing the lubricant level to the threshold value of lubricant and prior to sending the second command to open the lubricant valve; and activate the second compressor after sending the second command to open the lubricant valve.

22. The HVAC system of claim 21, wherein the lubricant level in the second sump is a first lubricant level, and wherein the controller is configured to, after activating the second compressor:

detect a second lubricant level in the second sump;

compare the second lubricant level to the threshold value of lubricant associated with the conventional operation; and send a fourth command to close the lubricant valve upon a determination that the second lubricant level is greater than or equal to the threshold value of lubricant.

23. The HVAC system of claim 20, wherein the amount of subcooling is a first amount of subcooling, and wherein the controller is configured to, after sending the third command:

determine a second amount of subcooling of refrigerant downstream of the second condenser;

compare the second amount of subcooling of refrigerant to the threshold value of subcooling associated with the conventional operation; and send a fourth command to close the refrigerant valve disposed along the refrigerant conduit upon a determination that the second amount of subcooling is greater than or equal to the threshold value of subcooling associated with the conventional operation.

* * * * *